US008740323B2

(12) United States Patent
Nelson et al.

(10) Patent No.: US 8,740,323 B2
(45) Date of Patent: Jun. 3, 2014

(54) VISCOSITY MODULATED DUAL FEED CONTINUOUS LIQUID EJECTOR

(75) Inventors: Shelby F. Nelson, Pittsford, NY (US); Andrew D. Thompson, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 185 days.

(21) Appl. No.: 13/280,469

(22) Filed: Oct. 25, 2011

(65) Prior Publication Data

US 2013/0100183 A1 Apr. 25, 2013

(51) Int. Cl.
*B41J 29/38* (2006.01)

(52) U.S. Cl.
USPC ..... 347/6; 347/73

(58) Field of Classification Search
USPC ..... 347/73, 75–80, 6
See application file for complete search history.

(56) References Cited

U.S. PATENT DOCUMENTS

| | | | | |
|---|---|---|---|---|
| 3,878,519 | A | 4/1975 | Eaton | |
| 4,636,808 | A | 1/1987 | Herron | |
| 4,638,328 | A | 1/1987 | Drake et al. | |
| 4,723,129 | A | 2/1988 | Endo et al. | |
| 4,740,796 | A | 4/1988 | Endo et al. | |
| 5,481,287 | A | 1/1996 | Tachihara | |
| 5,912,685 | A * | 6/1999 | Raman | 347/65 |
| 6,382,782 | B1 | 5/2002 | Anagnostopoulos et al. | |
| 6,457,807 | B1 | 10/2002 | Hawkins et al. | |
| 6,491,362 | B1 | 12/2002 | Jeanmaire | |
| 6,494,554 | B1 * | 12/2002 | Horii et al. | 347/10 |
| 6,505,921 | B2 | 1/2003 | Chwalek et al. | |
| 6,554,410 | B2 * | 4/2003 | Jeanmaire et al. | 347/77 |
| 6,575,566 | B1 | 6/2003 | Jeanmaire et al. | |
| 6,588,888 | B2 | 7/2003 | Jeanmaire et al. | |
| 6,780,339 | B2 | 8/2004 | Anagnostopoulos et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,364,276 | B2 | 4/2008 | Piatt et al. | |
| 2009/0002458 | A1 * | 1/2009 | Furukawa et al. | 347/58 |
| 2009/0033727 | A1 | 2/2009 | Anagnostopoulos et al. | |
| 2009/0225112 | A1 | 9/2009 | Barbet | |
| 2011/0074883 | A1 * | 3/2011 | Ozawa | 347/47 |

OTHER PUBLICATIONS

Lebens, J. A. et al., U.S. Appl. No. 12/768,759, filed Apr. 28, 2010.

* cited by examiner

*Primary Examiner* — Jason Uhlenhake
(74) *Attorney, Agent, or Firm* — William R. Zimmerli

(57) ABSTRACT

A continuous liquid ejector includes a structure including a wall. A portion of the wall defines a nozzle having a first fluidic resistance $R_1$. A first liquid feed channel is in fluid communication with the nozzle. The first liquid feed channel has a second fluidic resistance $R_2$. A first drop forming mechanism is associated with the first liquid feed channel. A second liquid feed channel is in fluid communication with the nozzle. The second liquid feed channel has a third fluidic resistance $R_3$. The first fluidic resistance $R_1$ is less than the second fluidic resistance $R_2$ plus the third fluid resistance $R_3$ ($R_1<(R_2+R_3)$). A second drop forming mechanism associated with the second liquid feed channel.

16 Claims, 17 Drawing Sheets

VISCOSITY MODULATED DUAL FEED CONTINUOUS LIQUID EJECTOR

FIELD OF THE INVENTION

This invention relates generally to the field of digitally controlled liquid ejection systems, and in particular to continuous liquid ejection systems in which a liquid stream breaks into drops at least some of which are deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CU).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

In the field of inkjet printing, there is a desire to provide better quality prints more quickly than can be currently provided using commercially available printheads. Efforts are being made to increase inkjet printhead operating frequencies and improve the placement accuracy of drops ejected from inkjet printheads. Accordingly, there is an ongoing need to provide liquid drop ejectors that have increased firing frequency and increased accuracy for drop ejection and drop placement on a receiver.

SUMMARY OF THE INVENTION

According to one aspect of the invention, a continuous liquid ejector includes a structure including a wall. A portion of the wall defines a nozzle having a first fluidic resistance $R_1$. A first liquid feed channel is in fluid communication with the nozzle. The first liquid feed channel has a second fluidic resistance $R_2$. A second liquid feed channel is in fluid communication with the nozzle. The second liquid feed channel has a third fluidic resistance $R_3$. The first fluidic resistance $R_1$ is less than the second fluidic resistance $R_2$ plus the third fluid resistance $R_3$ ($R_1<(R_2+R_3)$).

According to another aspect of the invention, a first drop forming mechanism is associated with the first liquid feed channel and a second drop forming mechanism associated with the second liquid feed channel.

According to another aspect of the invention, a drop forming mechanism is positioned in the region of the liquid ejector where first liquid feed channel and second liquid feed channel converge prior to the nozzle when viewed in a direction of liquid travel though the first liquid feed channel, through the second liquid feed channel and through the nozzle.

According to another aspect of the invention, a method of printing includes providing a continuous liquid ejector. The continuous liquid ejector includes a structure including a wall defining a nozzle. The nozzle has a fluidic resistance $R_1$. A first liquid feed channel is in fluid communication with the nozzle. The first liquid feed channel has a fluidic resistance $R_2$. A first drop forming mechanism is associated with the first liquid feed channel. A second liquid feed channel is in fluid communication with the nozzle. The second liquid feed channel has a fluidic resistance $R_3$. The fluidic resistance $R_1$ is less than the fluidic resistance $R_2$ plus the fluid resistance $R_3$ ($R_1<(R_2+R_3)$). A second drop forming mechanism is associated with the second liquid feed channel. A liquid is provided under pressure sufficient to eject a liquid jet through the nozzle of the continuous liquid ejector. The first drop forming mechanism and the second drop forming mechanism are simultaneously actuated to cause a portion of the liquid to break off from the liquid jet and form a liquid drop.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
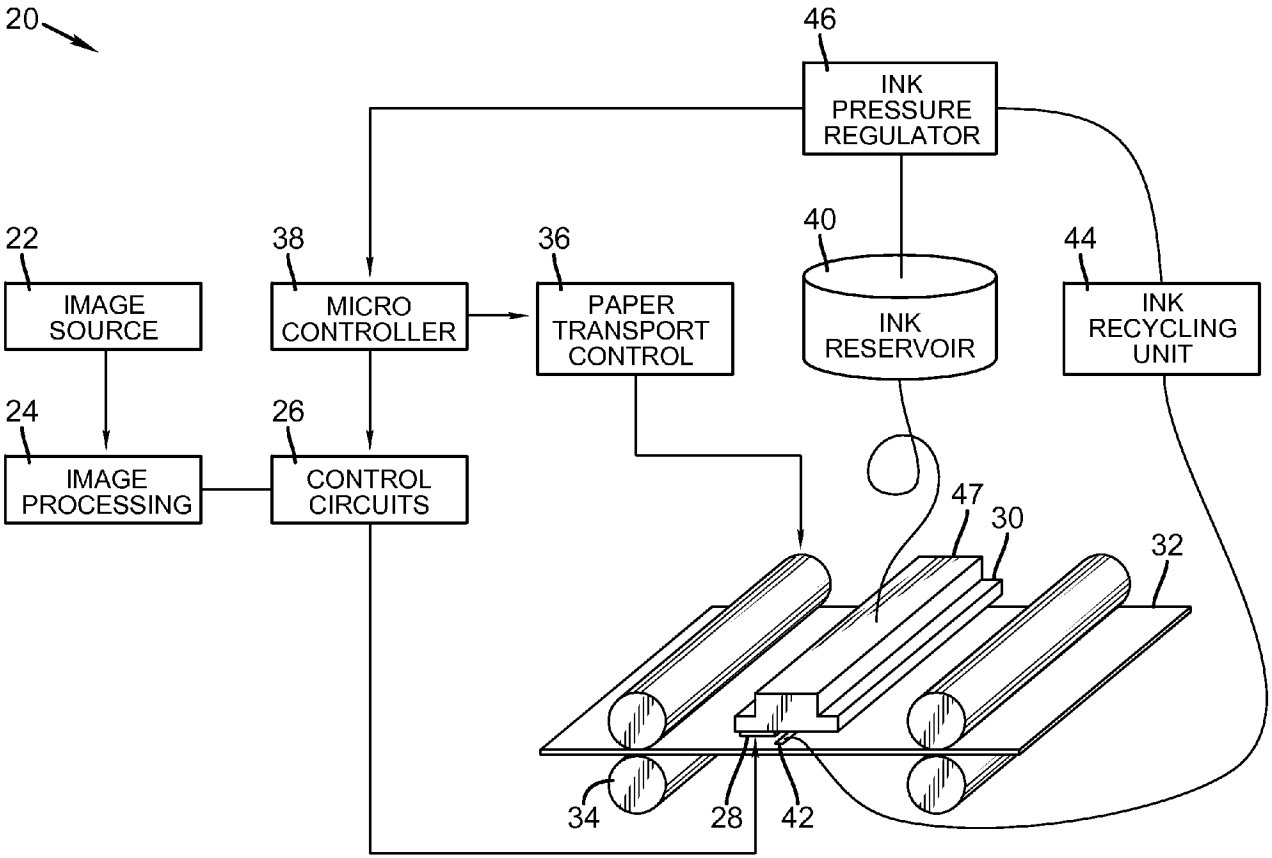
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide liquid ejection components typically used in inkjet printing systems. However, many other applications are emerging which use inkjet printheads to emit liquids (other than inks) or other materials that need to be finely metered and deposited with high spatial precision. Such materials or other liquids include, for example, functional materials for fabricating devices (including conductors, resistors, insulators, magnetic materials, and the like), structural materials for forming three-dimensional structures, biological materials, and various chemicals. As such, as described herein, the terms "liquid," "ink," "print," and "printing" refer to any material that can be ejected by the liquid ejector, the liquid ejection system, or the liquid ejection system components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28, 29 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. When this is done, the ink pressure regulator 46 can include an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
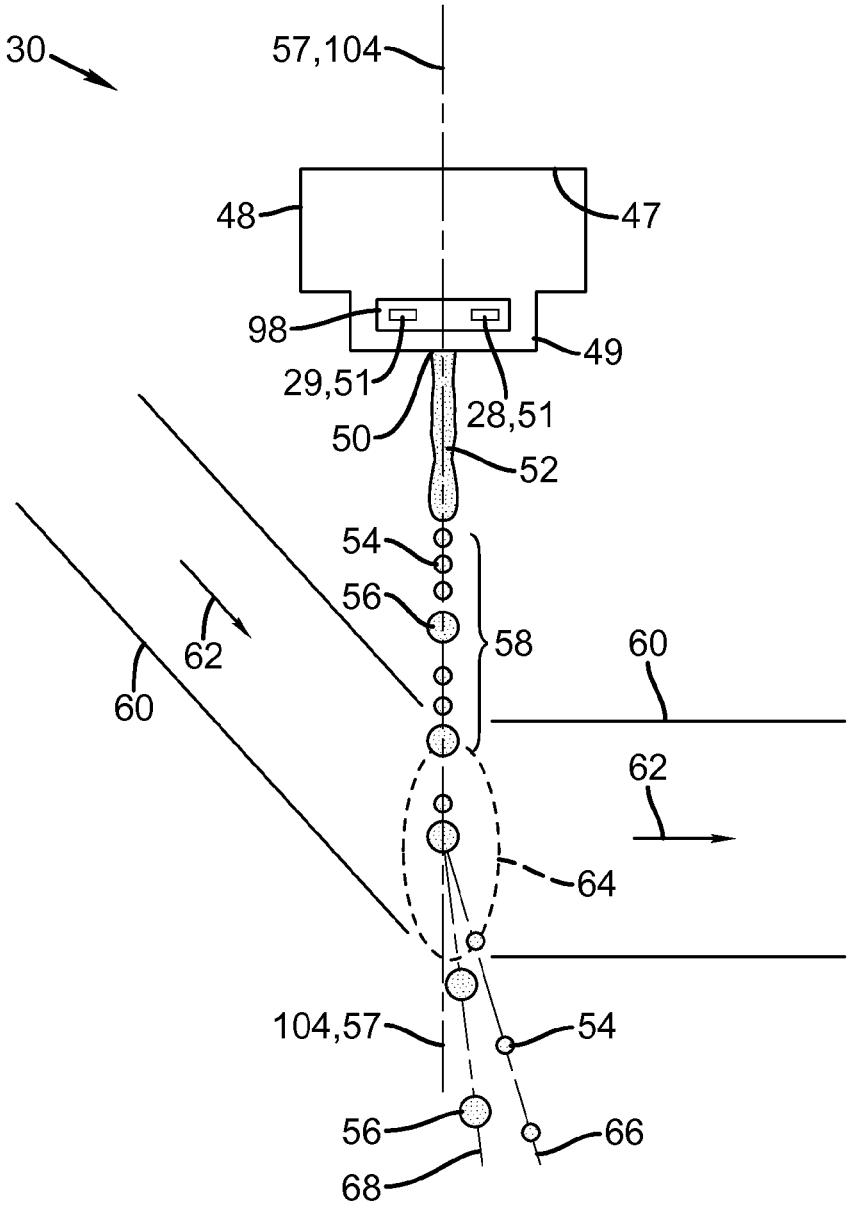
FIG. 2 is a schematic view of an example embodiment of a continuous printhead made in accordance with the present invention.
Figure 3:
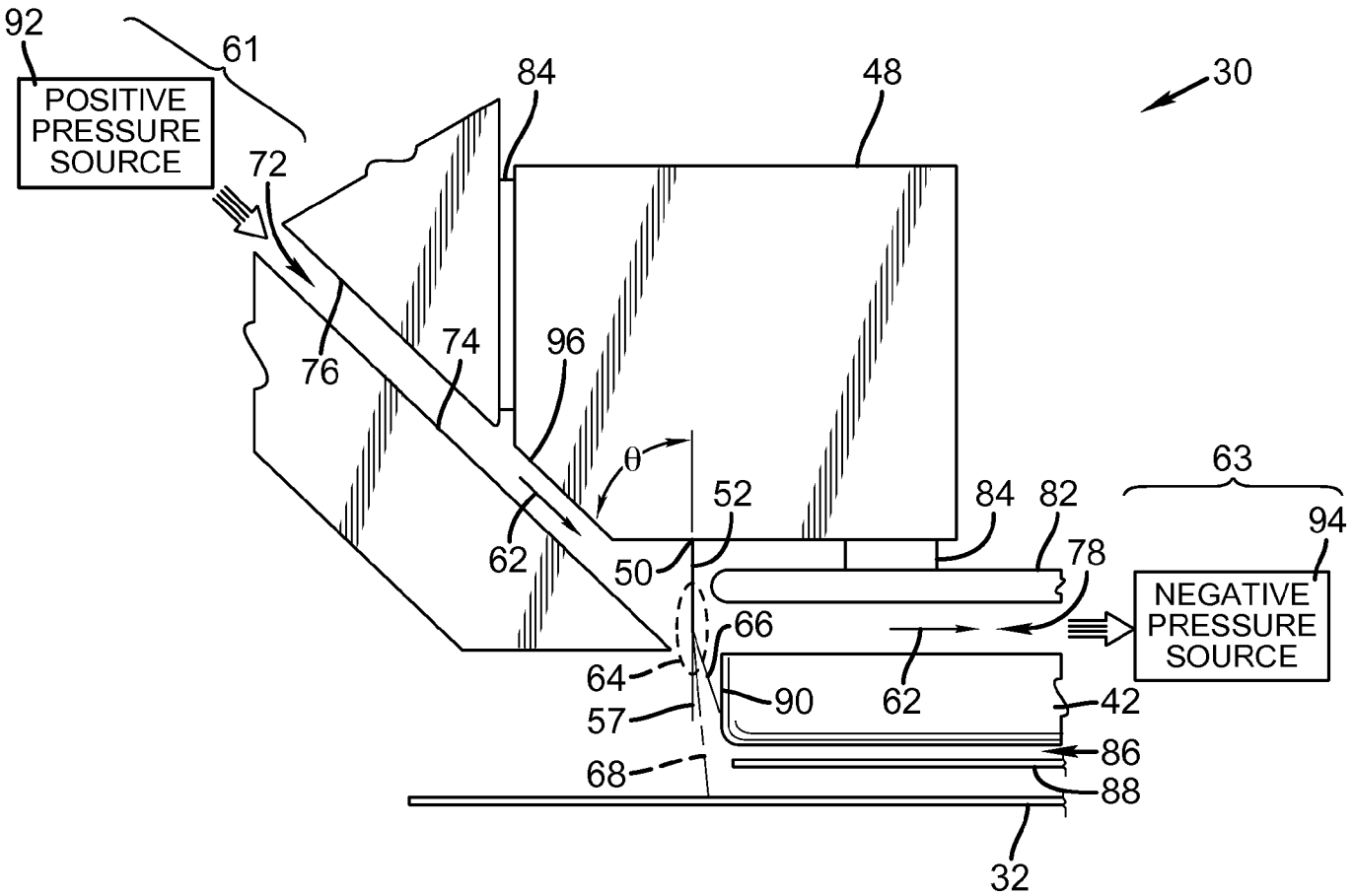
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48. Liquid, for example, ink, is emitted under pressure through each nozzle 50 of the array to form filaments of liquid 52. In FIG. 2, the array or plurality of nozzles extends into and out of the figure.

Jetting module 48 forms liquid drops having a first size or volume and liquid drops having a second size or volume through each nozzle. To accomplish this, jetting module 48 includes drop stimulation or drop forming devices 28, 29, for example, a heater or a piezoelectric actuator, that, when selectively activated, perturbs each filament of liquid 52, for example, ink, to induce portions of each liquid filament to break off from the filament and coalesce to form drops 54, 56. As shown in FIG. 2, drop forming devices 28, 29 are heaters 51. Using heaters to form drops is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Referring back to FIG. 2, in the present invention, heaters 51 are positioned in a plate 98 on both sides of an axis 104 extending through the center of the nozzle 50. Plate 98 is located opposite nozzle plate 49 and spaced apart from nozzle plate 49 such that liquid feeds are created. The liquid feeds, described in more detail below, provide liquid from liquid channel 47 to nozzle 50. As two liquid feeds are present, the liquid is provided to nozzle 50 from both sides of the axis 104 of the nozzle 50.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form filaments of liquid 52. In FIG. 3, the array or plurality of nozzles 50 extends into and out of the figure. Drop stimulation or drop forming devices 28, 29 (shown in FIG. 2) associated with jetting module 48 are selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and either can be used usually the selection depending on the application contemplated. Alternatively, catcher 42 can be of any suitable design including, but not limited to, a porous face catcher, a delimited edge catcher, or combinations of any of those described above.

Figure 4:
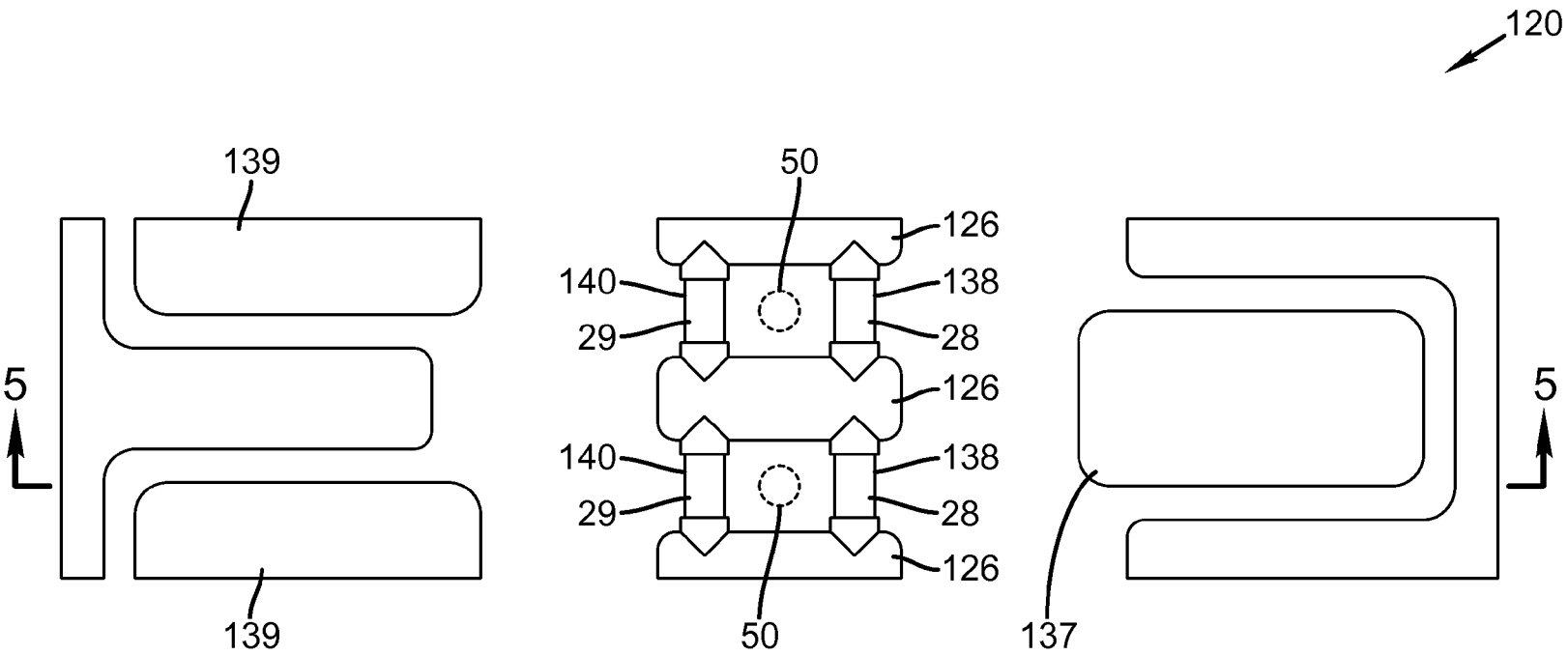
FIG. 4 is a schematic top view of an example embodiment of a continuous liquid ejector of a jetting module of a continuous printhead made in accordance with the present invention.
Figure 5:
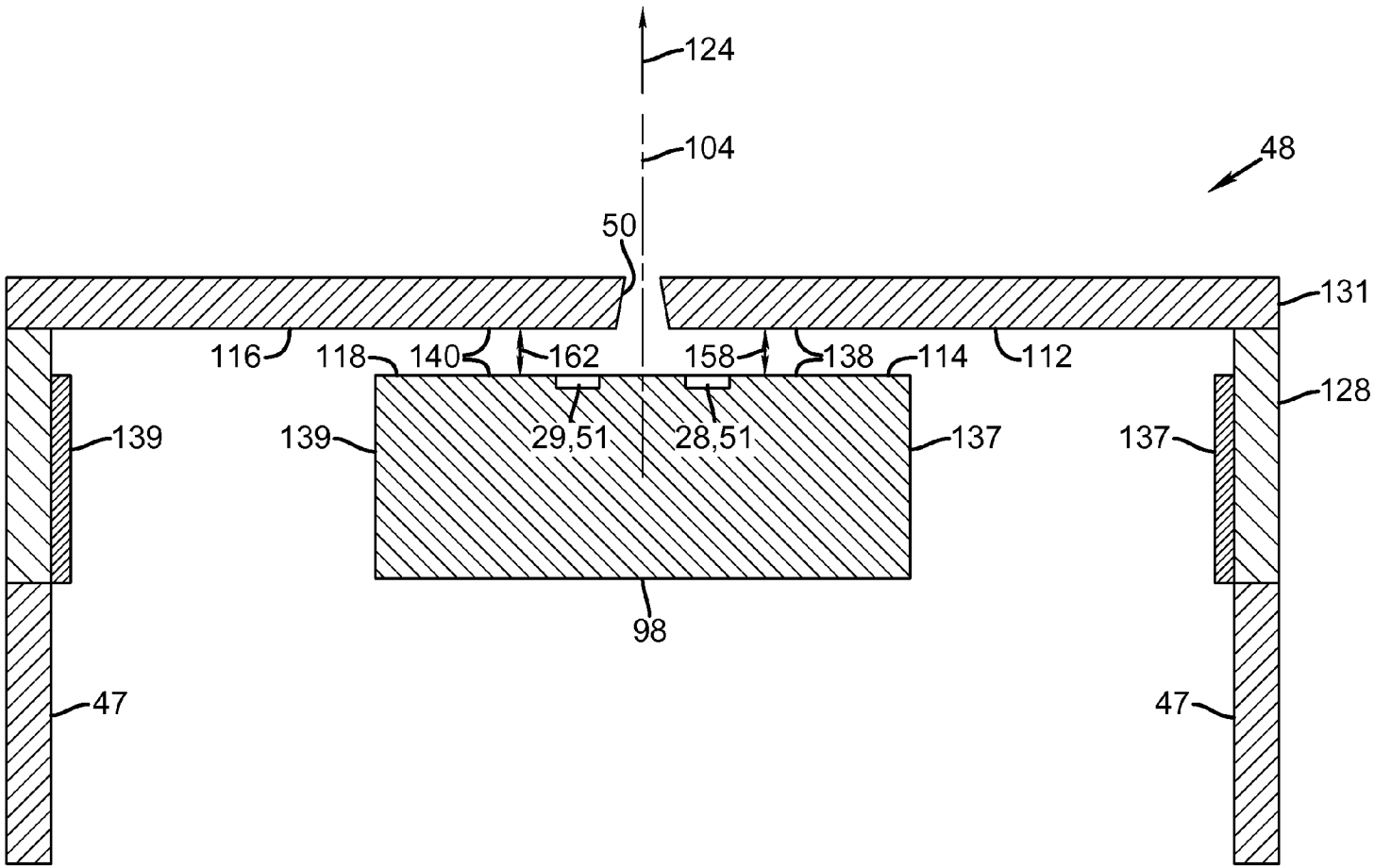
FIG. 5 is a schematic cross sectional view of the example embodiment shown in FIG. 4 as viewed along line 5-5 of FIG. 4.

Referring to FIGS. 4 and 5, an example embodiment of a jetting module 48 of a continuous printhead 30 of printing system 20 made in accordance with the present invention is shown. Jetting module 48 includes an array or plurality of liquid ejectors 120. Liquid ejector 120 includes a structure that includes a wall, for example, nozzle plate 131. A portion of the wall defines a nozzle 50. Nozzle 50 includes a first fluidic resistance $R_1$A first liquid feed channel 138 is in fluid communication with nozzle 50. The first liquid feed channel 138 includes a second fluidic resistance $R_2$. A second liquid feed channel 140 is in fluid communication with nozzle 50. The second liquid feed channel includes a third fluidic resistance $R_3$. First liquid feed 138 and second liquid feed channel 140 are located on opposite sides of nozzle(s) 50 and positioned in an aligned manner relative to each other. In the present invention, the first fluidic resistance $R_1$ is less than the second fluidic resistance $R_2$ plus the third fluid resistance $R_3$ ($R_1<(R_2+R_3)$). This aspect of the invention is discussed in more detail below.

For the nozzle 50, which has a thickness $L_{noz}$, and a radius r assumed to be constant through the thickness, the fluidic resistance for a fluid with a viscosity μ, for example, $R_2$ or $R_3$, can be calculated approximately, given a width W, a height H, and a length $L_{ch}$, for a fluid with a given viscosity μ, by $$R_{ch} = \frac{12 * \mu * L_{ch}}{W * H^3} * \left(1 - \sum_{n=1}^{\infty} 192 \frac{H}{W} * \frac{1}{(n * \pi)^5} * \tanh\left(\frac{n * \pi * W}{2H}\right)\right)^{-1}$$

This formula can apply equally to the first liquid feed channel and to the second liquid feed channel, with appropriate substitution of the width, height and length of each channel. In general, the width, height, and length of first and second feed channels will be identical, so that $R_2$ and $R_3$ will be equal.

A first drop forming mechanism 28 is associated with first liquid feed channel 138. A second drop forming mechanism 29 is associated with second liquid feed channel 140. First drop forming mechanism 28 and second drop forming mechanism 29 of one of the liquid ejectors 120 are different portions of the same drop forming mechanism (shown in more detail with reference to FIG. 13B). First drop forming mechanism 28 and second drop forming mechanism 29 are in electrical communication with each other through common electrical traces (or wires). This configuration of first drop forming mechanism 28 and second drop forming mechanism 29 facilitates the simultaneous actuation of the mechanisms while minimizing the number of electrical leads that are associated with the liquid ejector 120. In other example embodiments of the invention, first drop forming mechanism 28 and second drop forming mechanism 29 can be separate and distinct mechanisms that are not in electrical communication with each other and do not share electrical traces (or wires).

The structure of liquid ejector 120 also includes walls 126, often referred to as side walls of the liquid ejector 120, extending from a substrate 128 to the wall, for example, nozzle plate 131, that at least partially defines nozzle 50. Walls 126 separate liquid ejectors 120 positioned adjacent to other liquid ejectors 120.

Figure 7A:
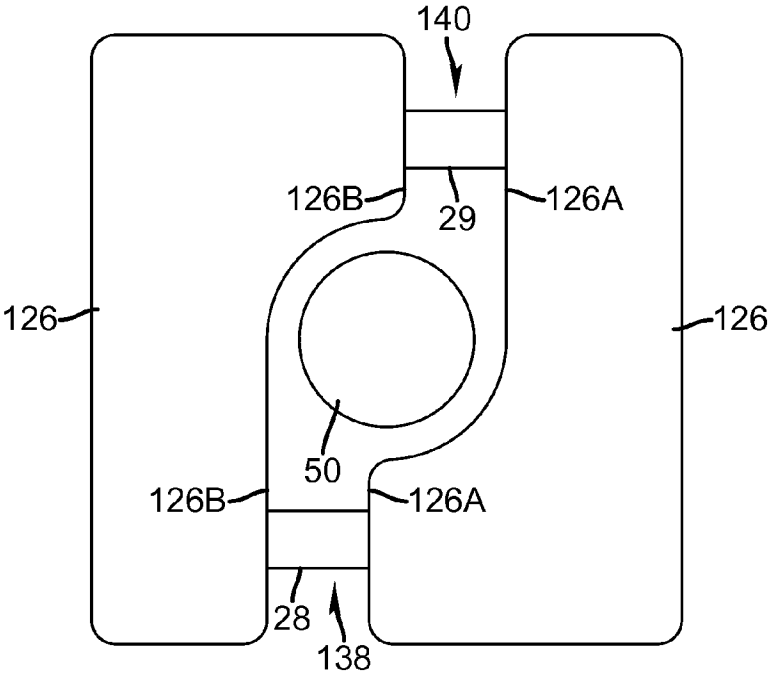
FIGS. 6A-7B are partial schematic top views of a portion of a continuous liquid ejector made in accordance with the present invention.
Figure 6A:
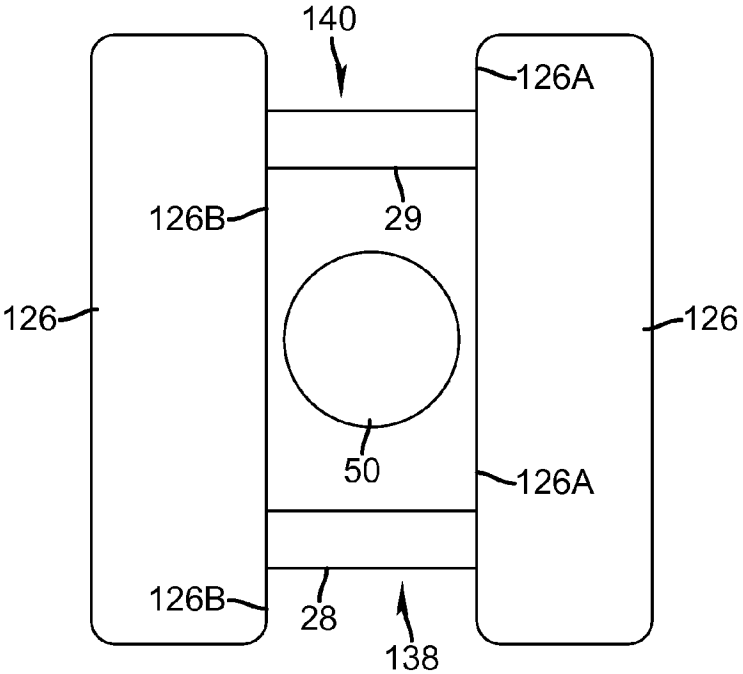
Figure 7B:
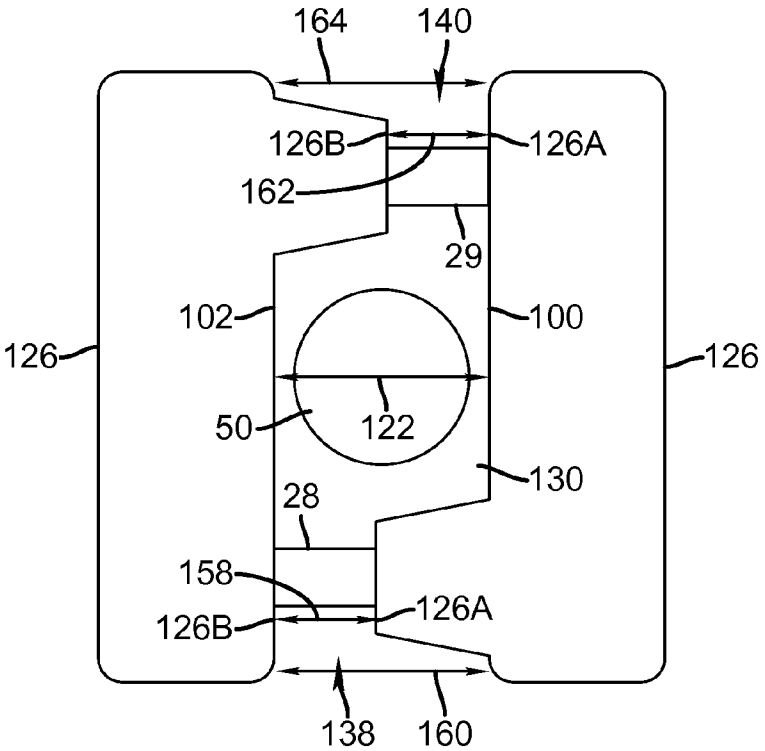
Figure 6B:
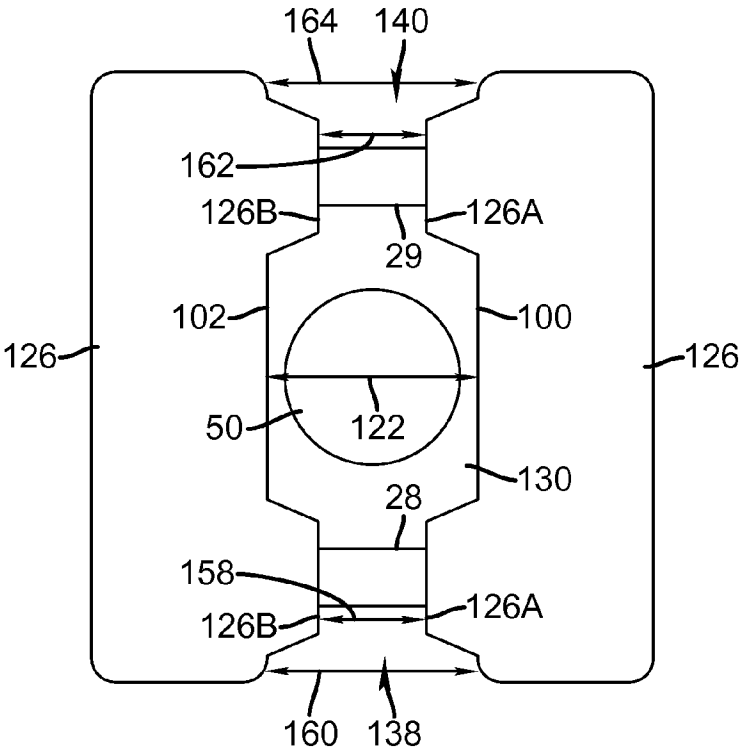

Preferably first liquid feed channel 138 and second liquid feed channel 140 have symmetry with respect to each other relative to nozzle 50. For example, first liquid feed channel 138 and second liquid feed channel 140 have a mirror symmetry with respect to each other relative to nozzle 50 as shown in FIGS. 6A and 6B. In other example embodiments of the invention, however, first liquid feed channel 138 and second liquid feed channel 140 have a 180 degree rotational symmetry with respect to each other relative to an axis 104 of nozzle 50 with the axis 104 being positioned perpendicular to the wall that at least partially defines nozzle 50 as shown in FIGS. 7A and 7B. Configuring first liquid feed channel 138 and second liquid feed channel 140 to have symmetry with respect to each other and relative to nozzle 50 helps to enhance the straightness of the jet of liquid 52 ejected through nozzle 50. The embodiments shown in FIGS. 6A and 7A include side walls 126 that have rounded corners while the embodiments shown in FIGS. 6B and 7B include side walls 126 that have corners have an angle or that end in a point.

As shown in FIGS. 4 and 5, first drop forming mechanism 28 is located in first liquid feed channel 138 and second drop forming mechanism 29 is located in second liquid feed channel 140. When actuated, usually simultaneously, first drop forming mechanism 28 and second drop forming mechanism 29 form drops from a liquid jet ejected through nozzle 50 as described above. Typically, first drop forming mechanism 28 and second drop forming mechanism 29 are positioned equally distant from an axis 104 of nozzle 50, the axis being positioned in the center of nozzle 50 as viewed in a direction of liquid flow 124 through nozzle 50, so as to maintain jet straightness or the desired trajectory of drop travel during drop formation.

Also as shown in FIGS. 4 and 5, first drop forming mechanism 28 is a resistive heater and second drop forming mechanism 29 is a resistive heater 51. First drop forming mechanism 28 and second drop forming mechanism 29, however, can be other types of drop forming mechanisms known in the art in other example embodiments of the invention. For example, first drop forming mechanism 28 can be a piezoelectric actuator and second drop forming mechanism 29 can be a piezoelectric actuator in another example embodiment of the invention. Preferably the action of the first drop forming mechanism 28 matches that of the second drop forming mechanism 29. For example, in embodiments in which the drop forming mechanisms are heaters, both have the same resistance so that they impart the same amount of heat to the fluid when activated by activation pulses from the drop forming mechanism control circuits 26.

As shown in FIG. 5, nozzle 50 includes a sidewalks) that taper in the direction of liquid flow 124 through nozzle 50 or relative to axis 104. In other example embodiments of the invention, however, the walls of nozzle 50 can be straight relative to the direction of liquid flow through nozzle 50 or axis 104. The tapering of the sidewalls of the nozzle helps to reduce the fluidic resistance of the nozzle relative to the fluidic resistance of the feed channels 138 and 140.

The structure of liquid ejector 120 includes a segmented liquid inlet that includes a first liquid inlet 137 (a first segment of the segmented liquid inlet) and a second liquid inlet 139 (a second segment of the segmented liquid inlet). First liquid inlet 137 and second liquid inlet 139 are typically located in substrate 128. First liquid inlet 137 is in fluid communication with feed channel 138 and second liquid feed inlet 139 is in fluid communication with feed channel 140. First liquid inlet 137 and second liquid inlet 139 are also in fluid communication with liquid channel 47, so that fluid supplied under pressure to the liquid channel 47 can flow through the inlets 137 and 139 to the feed channels 138 and 140. First liquid inlet 137 and second liquid inlet 139 are located on opposite sides of nozzle(s) 50 and positioned in a staggered, non-aligned manner relative to each other.

The average distance from a nozzle at which newly formed liquid drops separate from a liquid jet is commonly referred to as a drop break-off length. Stronger stimulation of the liquid by a drop forming mechanism(s) results in a shorter break-off length which helps to improve the placement accuracy of drops during a printing operation. Stronger stimulation of the liquid by the drop forming mechanism(s) also results in more stable drop formation, so that the position and velocity of the newly formed drops are more reproducible from drop to drop which also helps to improve the placement accuracy of drops during a printing operation.

In example embodiments of the invention in which the drop forming mechanism(s) are heaters, actuating the heaters causes the viscosity of the liquid flowing past the heater to change. When actuated, the heaters heat a portion of the liquid flowing through each liquid feed channel without vaporizing a portion of the liquid. Stronger stimulation, still without liquid vaporization, can result from a higher temperature variation in the first drop formation mechanism 28 and in the second drop formation mechanism 29. For a fixed input energy, the amount of stimulation is optimized by proper placement of the drop formation mechanisms 28 and 29 in the first and second liquid feed channels 138 and 140 and by proper choice of liquid feed channel and nozzle geometries in order to improve (for example, by increasing or enhancing) the modulation of the flow rate of the liquid flowing through nozzle 50.

For typical pressures and liquids, for example, inks, used in a jetting module of a continuous printhead, the flow of the liquid can be considered laminar. In laminar liquid flow, a resistance to fluid flow through a channel(s) that depends on the geometry of the channel and on the properties of the fluid (primarily the viscosity) can be determined. The fluidic resistance relates the volumetric fluid flow to the pressure difference across a given channel and can be measured or calculated.

Referring back to FIGS. 4 and 5, the fluidic resistance in liquid ejector 120 can be considered as having three contributions on each side of nozzle 50, the side of nozzle 50 that includes first liquid feed channel 138 and the side of nozzle 50 that includes second liquid feed channel 140. Referring to the side of nozzle 50 that includes first liquid feed channel 138, a first contribution to the fluidic resistance comes from nozzle 50 and is referred to herein as $R_1$. A second contribution to the fluidic resistance comes from first liquid feed channel 138 and is referred to herein as $R_2$. A third contribution to the fluidic resistance comes from the region between first liquid inlet 137 and the entrance to first liquid feed channel 138 and is referred to herein as $R_4$.

The side of nozzle 50 that includes second liquid feed channel 140 includes the same three contributors to the fluid resistance of liquid ejector 120. A first contribution to the fluidic resistance comes from nozzle 50 and is referred to herein as $R_1$. A second contribution to the fluidic resistance comes from second liquid feed channel 140 and is referred to herein as $R_3$. A third contribution to the fluidic resistance comes from the region between second liquid inlet 139 and the entrance to second liquid feed channel 140 and is referred to herein as $R_5$.

In the present invention, the first fluidic resistance $R_1$ is less than the second fluidic resistance $R_2$ plus the third fluid resistance $R_3$ ($R_1<(R_2+R_3)$) so that desired volumetric fluid flow is obtained at a desired fluid pressure. In this manner, strong liquid jet stimulation, discussed above, is provided by the drop forming mechanisms 28 and 29 leading to improved drop formation and improved drop placement, also discussed above. Preferably, fluidic resistance $R_2$ is present in a location of first liquid feed channel 138 that also includes the location of drop formation mechanism 28 and fluidic resistance $R_3$ is present in a location of second liquid feed channel 140 that also includes the location of drop formation mechanism 29. In example embodiments of the invention having two symmetric first and second segmented liquid inlets 137 and 139, $R_2$ is equivalent to $R_3$. In such cases, the condition $R_1<(R_2+R_3)$ is equivalent to $R_1<2*R_2$.

When the total fluidic resistance of the jetting module is calculated, the resistance from the liquid inlets and liquid feed channels appears halved, as half of the liquid passing through the nozzle passes through the left side feed channel and half through the right side feed channel. This can be understood by analogy to electrical circuits, in which the effective resistance of two identical electrical resistors in parallel is one half of either individual resistance. Thus, the total fluidic resistance for a liquid ejector 120 in this example embodiment is $R_1$ plus one half of the sum of $R_2$ and $R_4$. The sum of the three fluidic resistances, $R_1+(R_2+R_4)/2$, should be low enough to get a preferred volumetric fluid flow at a desired fluid pressure. In this example embodiment, for strong drop formation stimulation, the fluidic resistance $R_1$ of nozzle 50 should be less than 2 times the fluidic resistance $R_2$ in the feed channel 138 where drop formation mechanism 28 is located, and the fluidic resistance $R_1$ of nozzle 50 is less than 2 times the fluidic resistance $R_3$ in the feed channel 140 where drop formation mechanism 29 is located because first and second liquid feed channels 138 and 140 are symmetric. Preferably, the fluidic resistance $R_1$ of nozzle 50 is equal to the fluidic resistance $R_2$ of liquid feed channel 138 and the fluidic resistance $R_3$ in the feed channel 140. Even more preferably, the fluidic resistance $R_1$ of nozzle 50 is less than the fluidic resistance $R_2$ of liquid feed channel 138 and the fluidic resistance $R_3$ in the feed channel 140.

Referring back to FIG. 5, first liquid feed channel 138 includes a first surface 112 and a second surface 114 that are separated from each other by a distance 158. Distance 158 does not vary from the beginning to the end of first liquid feed channel 138. Instead, the distance 158 between first surface 112 and second surface 114 remains equal (remains constant) throughout the length of channel 138. Second liquid feed channel 140 includes a first surface 116 and a second surface 118 that are separated from each other by a distance 162. Distance 162 does not vary from the beginning to the end of second liquid feed channel 140. Instead, distance 162 remains constant (remains equal) throughout the length of channel 140. The fluidic resistance of a feed channel is increased by decreasing the distance 158 and the distance 162 when compared to the distances associated with a convention liquid drop ejector. During drop formation, the actuation from drop formation mechanism 28 and drop formation mechanism 29 affects a fraction of the fluid located adjacent to each drop formation mechanism. When the distance 158 and the distance 162 are smaller, the fraction of fluid affected by the drop formation actuation is higher. For example, when the drop forming device is a heater, heat from the heater can diffuse into a larger fraction of the liquid flowing through the feed channel 138 or 140 when the height of the flow channel, that is the distance 158 or 162, is reduced. Therefore for the same input energy, a stronger stimulation is achieved. Decreasing the distance 158 and distance 162, however, also increases the fluidic resistances $R_4$ and $R_5$ between liquid inlets 137 and 139 and liquid feed channels 138 and 140. Although the increase in fluidic resistances $R_4$ and $R_5$ does not, typically, enhance drop formation stimulation, it may necessitate a higher pressure to force a given volumetric fluid flow through the nozzle 50 of liquid ejector 120. Additional example embodiments of the invention that address this issue are discussed below with reference to FIGS. 10-16.

Figure 8:
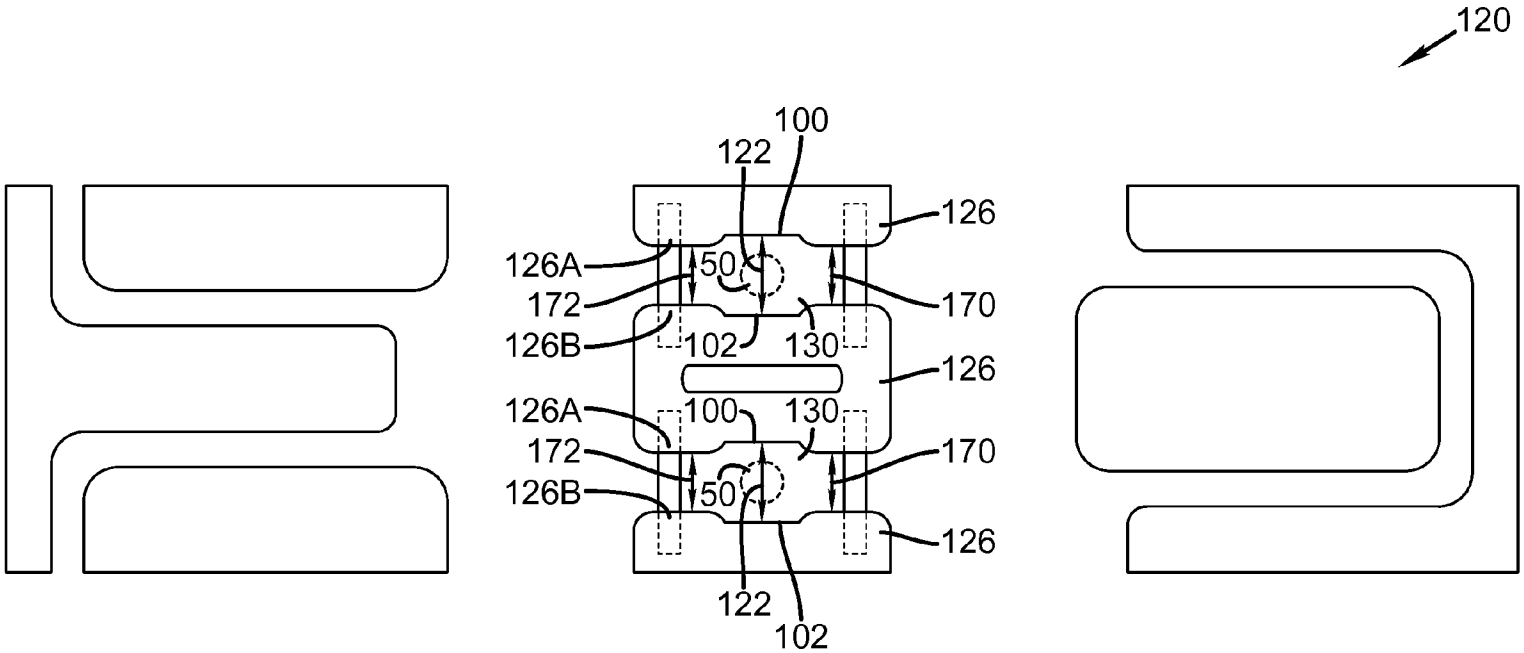
FIG. 8 is a schematic top view of another example embodiment of a continuous liquid ejector of a jetting module of a continuous printhead made in accordance with the present invention.

When the drop formation mechanism in one liquid ejector 120 is activated, some stimulation may occur in fluid jets ejected from neighboring liquid ejectors 120. This effect is commonly referred to as cross-talk. Some example embodiments of liquid ejector 120 include features to minimize cross-talk. Referring to FIG. 8 and back to FIGS. 6B and 7B, liquid ejector 120 includes a first side wall 100 and a second side wall 102 in a region of liquid ejector 120, which can be referred to as a chamber 130, where first liquid feed channel 138 and second liquid feed channels 140 converge prior to nozzle 50 (when viewed in the direction of liquid travel though the feed channels and through the nozzle). Typically, side walls 100 and 102 are portions of walls 126. A width of chamber 130 is defined by the distance 122 between first side wall 100 and second side wall 102. First liquid feed channel 138 includes a first side wall 126A, which is, typically, a portion of wall 126 in the first feed channel and a second side wall 126B which is, typically, a portion of the opposite side wall 126 in the first feed channel. A width of first liquid feed channel 138 is defined by the distance 170 between first side wall 126A and second side wall 126B. Second liquid feed channel 140 includes a first side wall 126A, which is, typically, a first portion of wall 126 and a second side wall 126B which is, typically, a second portion of the opposite side wall 126. A width of second liquid feed channel 140 is defined by the distance 172 between the first side wall 126A and second side wall 126B. Typically, symmetry between first liquid feed channel 138 and second liquid feed channel 140 enhances jet straightness, so the width 170 of first liquid feed channel 138 and the width 172 of second liquid feed channel 140 are equivalent. In some example embodiments of the invention, cross-talk between neighboring liquid ejectors 120 can be minimized when the width 122 of chamber 130 is greater than the distance 170 associated with the width of first liquid feed channel 138 and when the width 122 of chamber 130 is greater than the distance 172 associated with the width of second liquid feed channel 140.

Figure 9:
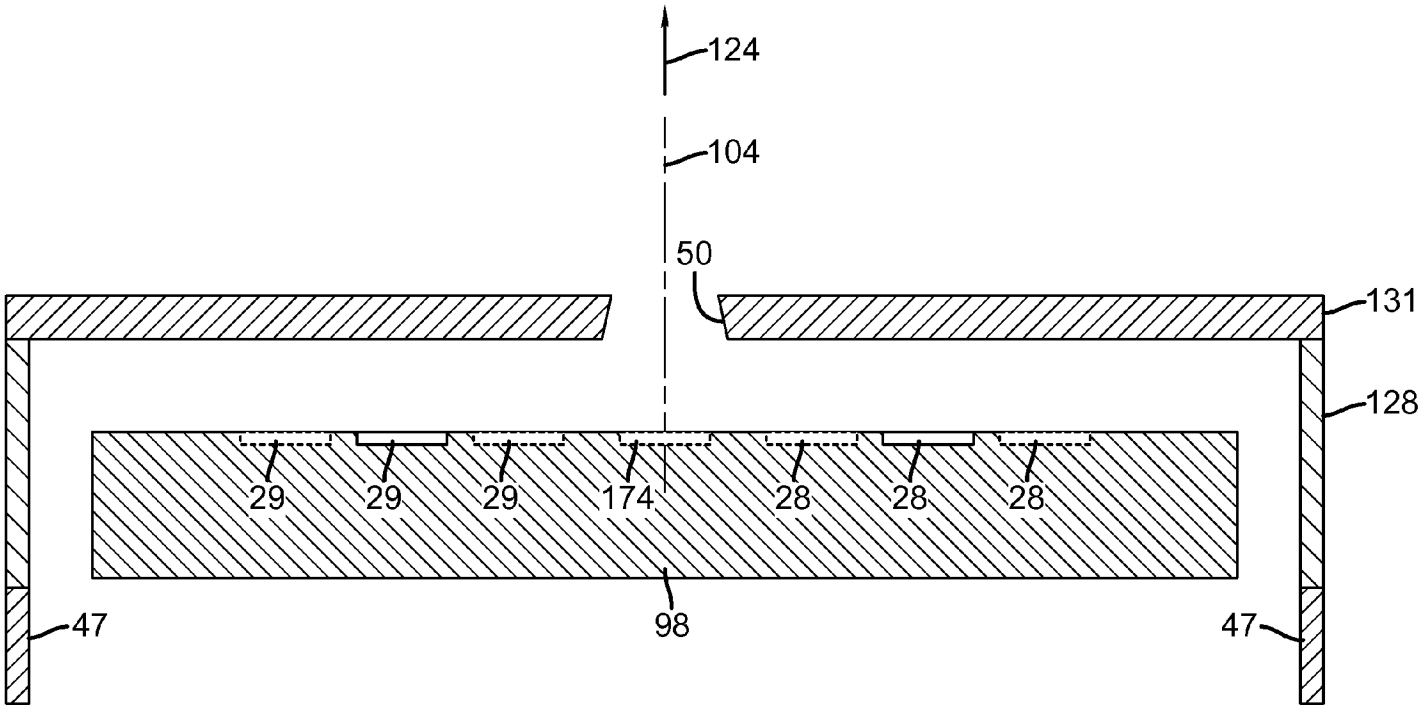
FIG. 9 is a schematic cross sectional side view of additional example embodiments of a continuous liquid ejector made in accordance with the present invention.

Referring to FIG. 9, additional drop forming mechanisms are included in some example embodiments of the invention. For example, continuous liquid ejector 120 can include an additional drop forming mechanism 28 (or a plurality of additional drop forming mechanisms 28) in first liquid feed channel 138 and an additional drop forming mechanism 29 (or a plurality of additional drop forming mechanisms 29) in second liquid feed channel 140. Typically, the additional drop forming mechanisms 28 and 29 are positioned in or on plate 98 equally distant from center axis 104 of nozzle 50 so as to maintain jet straightness or the desired trajectory of drop travel during drop formation. Alternatively, continuous liquid ejector 120 can include a third drop forming mechanism 174 positioned between first drop forming mechanism 28 and second drop forming mechanism 29. When third drop forming mechanism 174 is included, third drop forming mechanism 174 is typically positioned in the region of liquid ejector 120 where first liquid feed channel 138 and second liquid feed channels 140 converge prior to nozzle 50 (when viewed in the direction of liquid travel though the feed channels and in the direction of liquid travel 124 through the nozzle). Typically drop forming mechanism 174 is positioned in or on plate 98 and centered relative to center axis 104 of nozzle 50. This region of liquid ejector 120 can be referred to as chamber 130. In an alternative example embodiment of the present invention, continuous liquid ejector 120 includes only a single drop forming mechanism 174 positioned in the region of liquid ejector 120 where first liquid feed channel 138 and second liquid feed channel 140 converge prior to nozzle 50 (when viewed in the direction of liquid travel, also referred to a liquid flow, though the first and second feed channels and through the nozzle).

As shown in FIG. 9, drop forming mechanism(s) 174 is a resistive heater(s). However, drop forming mechanism(s) 174 can be other types of drop forming mechanisms known in the art in other example embodiments of the invention. For example, drop forming mechanism(s) 174 can be a piezoelectric actuator(s) in another example embodiment of the present invention.

Referring back to FIGS. 1-9, having described the basic components of liquid ejector 120, the operation of liquid ejector 120 will now be described. A liquid, for example, ink, is supplied to jetting module 48 under pressure sufficient to continuously eject a jet or filament of the liquid through nozzle 50. The liquid enters and flows through nozzle 50 from opposite directions relative to the axis 104 of the nozzle after passing through first and second liquid feed channels 138, 140 and traveling through first and second segments 137, 139 of segmented liquid inlet.

As the liquid travels through first and second liquid feed channels 138, 140, first drop forming mechanism 28 and second drop forming mechanism 29, for example, resistive heating elements 51, are positioned in first and second liquid feed channels 138, 140 and are in thermal contact with the liquid. As described above, a plurality of drop forming mechanism control circuits 26 read data from the image memory and apply time-varying electrical pulses to resistive heaters 51 through electrical leads 156A and 156B (shown in FIG. 13) that are associated with nozzles 50 of printhead 30. These pulses are applied at an appropriate time, and to the appropriate nozzle, so that drops formed from a continuous ink jet stream will form spots on recording medium 32 in the appropriate position designated by the data in the image memory. In the alternative example embodiment of the invention that includes only a single drop forming mechanism 174, described above, the time-varying electrical pulses are applied to only the drop forming mechanism 174.

During operation, as the liquid travels through first liquid feed channel 138, the distance 158 between first surface 112 and second surface 114 does not vary from the beginning to the end of first liquid feed channel 138 in the example embodiment shown in FIG. 5. Instead, distance 158 remains constant throughout the length of the first liquid feed channel 138. The liquid experiences a fluid resistance $R_2$ as it travels through first liquid feed channel 138. Liquid traveling through second liquid feed channel 140 experiences a similar travel path and experiences a fluidic resistance $R_3$. The liquid also experiences a fluidic resistance $R_1$ as it travels through nozzle 50. The fluidic resistance $R_1$ of nozzle 50 that the liquid experiences as it travels through nozzle 50 is less than the fluidic resistance $R_2$ of first liquid feed channel 138 plus the fluid resistance $R_3$ of second liquid feed channel 140 ($R_1<(R_2+R_3)$).

In example embodiments in which the drop forming mechanisms 28 and 29 are heaters, actuating the heaters causes the viscosity of the liquid flowing past the heater to change. Positioning first drop forming mechanism 28 and second drop forming mechanism 29 in first liquid feed channel 138 and in second liquid feed channel 140 helps to improve (for example, increase or enhance) the modulation in the flow rate of the liquid flowing through the liquid feed channels 138 and 140 and thus through nozzle 50.

In alternative example embodiments of the invention, the liquid ejectors include additional pairs of drop forming mechanisms 28 and 29, such as are shown in FIG. 9. Both drop forming mechanisms of each symmetric pair of a first drop forming mechanism and a second drop forming mechanism being actuated simultaneously. In a preferred embodiment of this, there is a time delay or phase shift in the actuation of one symmetric pair of drop forming mechanisms to the next, starting at the symmetric pair farthest from the nozzle during operation of the printing system. In this way, the successive actuations of the drop forming mechanisms in a liquid ejector can act constructively on the liquid passing through a feed channels toward the nozzle.

Referring to FIGS. 10-16 and back to FIGS. 6A-7B, additional example embodiments of the present invention are shown. Generally described, in these example embodiments of the invention the first liquid feed channel 138 includes a first surface 112 and a second surface 114 that are separated from each other by a distance. The separation distance 158 is smaller in a first portion 138A of the first liquid feed channel 138 when compared to the separation distance 160 in a second portion 138B of the first liquid feed channel 138. The first drop forming mechanism 28 is associated with the first portion 138A of the first liquid feed channel 138. Additionally, the second liquid feed channel 140 includes a first surface 116 and a second surface 118 that are separated from each other by a distance. The separation distance 162 is smaller in a first portion 140A of the second liquid feed channel 140 when compared to a separation distance 164 in a second portion 140B of the second liquid feed channel 140. The second drop forming mechanism 29 is associated with the first portion 140A of the second liquid feed channel 140.

The first portion 138A of the first liquid feed channel 138 is located between the nozzle 50 and the second portion 138B of the first liquid feed channel 138 while the first portion 140A of the second liquid feed channel 140 is located between the nozzle 50 and the second portion 140B of the second liquid feed channel 140. Alternatively, the second portion 138B of the first liquid feed channel 138 is located between the nozzle 50 and the first portion 138A of the first liquid feed channel 138 while the second portion 140B of the second liquid feed channel 140 is located between the nozzle 50 and the first portion 140A of the second liquid feed channel 140. In other alternative example embodiments, second portions 138B and 140B of liquid feed channels 138 and 140 can be located on both sides of first portion 138A and 140B of liquid feed channels 138 and 140. Additionally, the distances 158, 160, 162, 164 can be created using either side walls (see, for example, FIGS. 6A-7B) of liquid feed channels 138 and 140 or top and bottom walls of liquid feed channels 138 and 140 (see, for example, FIGS. 10-16).

In these example embodiments, the distance 160 and distance 164 are not significantly decreased. As such, the fluidic resistances $R_4$ and $R_5$ between liquid inlets 137 and 139 and liquid feed channels 138 and 140 are not significantly increased which reduces the pressure needed to force a given volumetric fluid flow through the nozzle 50 of liquid ejector 120 (when compared to devices in which distances 160 and 164 are reduced).

Referring to FIGS. 10-13B, liquid ejector 120 includes a structure that includes a wall, for example, nozzle plate 131. A portion of the wall defines a nozzle 50. Nozzle 50 includes a first fluidic resistance $R_1$. A first liquid feed channel 138 is in fluid communication with nozzle 50. The first liquid feed channel 138 includes a second fluidic resistance $R_2$. A second liquid feed channel 140 is in fluid communication with nozzle 50. The second liquid feed channel includes a third fluidic resistance $R_3$. First liquid feed 138 and second liquid feed channel 140 are located on opposite sides of nozzle(s) 50 and positioned in an aligned manner relative to each other. In the present invention, the first fluidic resistance $R_1$ is less than the second fluidic resistance $R_2$ plus the third fluid resistance $R_3$ ($R_1<(R_2+R_3)$). The wall(s) of nozzle 50 preferably taper in the direction of liquid flow 124 through nozzle 50. In the perspective view of the example embodiment shown in FIGS. 13A and 13B, nozzle plate 131 has been removed to more clearly show the structural elements of the invention located within liquid ejector 120.

First liquid feed channel 138 includes a first surface 112 and a second surface 114 that are separated from each other by a distance 158 which is smaller in a first portion 138A of first liquid feed channel 138 when compared to a distance 160 separating first surface 112 and second surface 114 in a second portion 138B of first liquid feed channel 138. A first drop forming mechanism 28 is associated with the first portion 138A of first liquid feed channel 138.

Second liquid feed channel 140 includes a first surface 116 and a second surface 118 that are separated from each other by a distance 162 which is smaller in a first portion 140A of second liquid feed channel 140 when compared to a distance 164 separating first surface 116 and second surface 118 in a second portion 140B of second liquid feed channel 140. A second drop forming mechanism 29 is associated with the first portion 140A of second liquid feed channel 140.

Figure 13A:
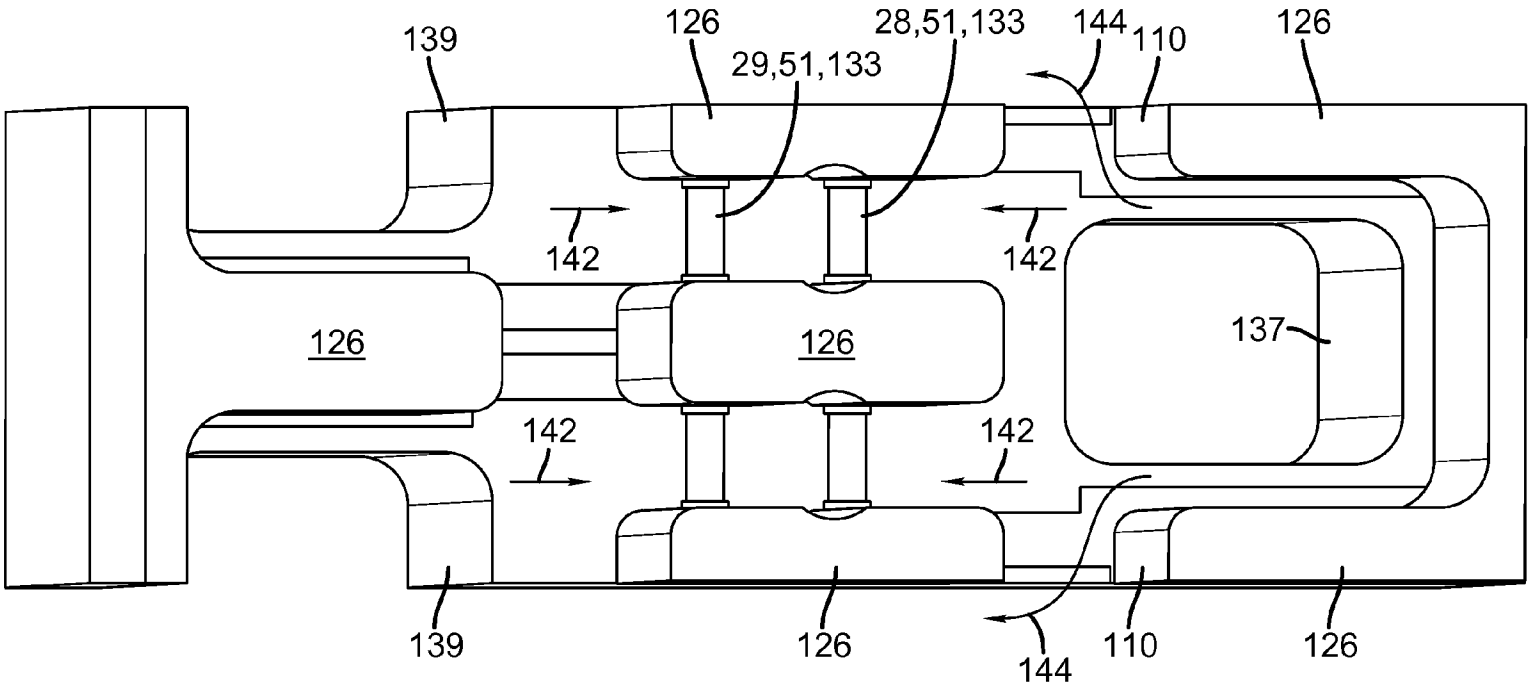
FIGS. 13A and 13B are partial schematic perspective views of the example embodiment shown in FIG. 10.
Figure 13B:
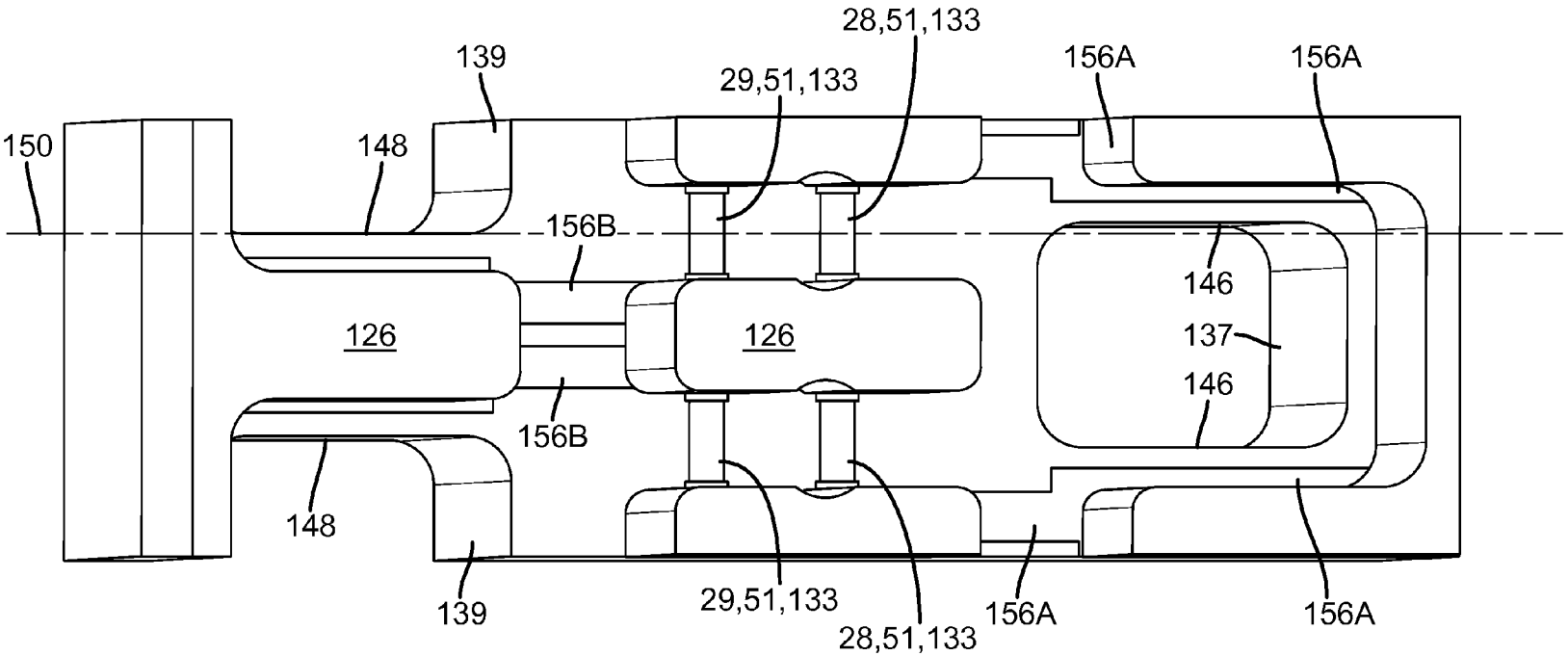

When actuated, usually simultaneously, first drop forming mechanism 28 and second drop forming mechanism 29 form drops from a liquid jet ejected through nozzle 50 as described above. Typically, first drop forming mechanism 28 and second drop forming mechanism 29 are positioned equally distant from axis 104 of nozzle 50 so as to maintain jet straightness or the desired trajectory of drop travel during drop formation. As shown in FIGS. 13A and 13B, first drop forming mechanism 28 and second drop forming mechanism 29 are different portions of the same drop forming mechanism. First drop forming mechanism 28 and second drop forming mechanism 29 are in electrical communication with each other through common electrical traces (or wires). This configuration of first drop forming mechanism 28 and second drop forming mechanism 29 facilitates the simultaneous actuation of the mechanisms while minimizing the number of electrical leads that are associated with the liquid ejector 120. In other example embodiments of the invention, first drop forming mechanism 28 and second drop forming mechanism 29 can be separate and distinct mechanisms that are not in electrical communication with each other and do not share electrical traces (or wires).

The structure of liquid ejector 120 also includes walls 126, often referred to as side walls of the liquid ejector 120, extending from a substrate 128 to the wall, for example, nozzle plate 131, that at least partially defines nozzle 50. Walls 126 separate liquid ejectors 120 positioned adjacent to other liquid ejectors 120.

Preferably first liquid feed channel 138 and second liquid feed channel 140 have a symmetry with respect to each other relative to nozzle 50. For example, first liquid feed channel 138 and second liquid feed channel 140 have a mirror symmetry with respect to each other relative to nozzle 50 as shown in FIGS. 6A and 6B. In other example embodiments of the invention, however, first liquid feed channel 138 and second liquid feed channel 140 have a 180 degree rotational symmetry with respect to each other relative to an axis 104 of nozzle 50 with the axis 104 being positioned perpendicular to the wall that at least partially defines nozzle 50 as shown in FIGS. 7A and 7B. Configuring first liquid feed channel 138 and second liquid feed channel 140 to have symmetry with respect to each other and relative to nozzle 50 helps to enhance the straightness of the jet of liquid 52 ejected through nozzle 50. The embodiments shown in FIGS. 6A and 7A include side walls 126 that have rounded corners while the embodiments shown in FIGS. 6B and 7B include side walls 126 that have corners have an angle or that end in a point.

The region of liquid ejector 120, which can be referred to as a chamber 130, where first liquid feed channel 138 and second liquid feed channels 140 converge prior to nozzle 50 (when viewed in the direction of liquid travel though the feed channels and through the nozzle) also includes a surface 106 (a third surface) of nozzle plate 131 (a bottom surface of nozzle plate 131 as shown in FIGS. 10-13B) and a surface 108 (a fourth surface) of substrate 128 (a top surface of substrate 128 as shown in FIGS. 10-13B). Surface 106 and surface 108 are separated by a distance 166 that can be greater than the distance 158 associated with the first portion 138A of first liquid feed channel 138. Distance 166 can also be also greater than the distance 162 associated with the first portion 140A of second liquid feed channel 140. When configured in this manner, cross-talk between neighboring liquid ejectors 120 can be minimized. Alternatively or additionally, cross-talk between neighboring liquid ejectors 120 in the example embodiments described with reference to FIGS. 10-13B can be minimized when the width 122 of chamber 130 is greater than the distance 170 associated with the width of first liquid feed channel 138 and the width 122 of chamber 130 is greater than the distance 172 associated with the width of second liquid feed channel 140 as was described above with reference to FIG. 8.

As shown in FIGS. 10-13B, distance 158 and distance 162 are smaller than distance 160 and 164 because a portion of nozzle plate 131 extends into first liquid feed channel 138 and into second liquid feed channel 140. Referring back to FIGS. 6B-7B, in alternative example embodiments side walls 126 extend into first liquid feed channel 138 and second liquid feed channel 140 in the same areas of the first liquid feed channel 138 and second liquid feed channel 140 (first portion regions 138A and 140A) in order to accomplish the same objective.

Referring back to FIGS. 10-13B and FIGS. 4-8, a segmented liquid inlet supplies liquid to nozzle 50 through first liquid feed channel 138 and second liquid feed channel 140. Segmented liquid inlet includes a first segment 137 that is in fluid communication with first liquid feed channel 138 and a second segment 139 that is in fluid communication with second liquid feed channel 140. First segment 137 and second segments 139 are positioned on opposite sides of nozzle 50 in a staggered non-aligned fashion.

Nozzle 50 is connected in fluid communication with first liquid feed channel 138 which is connected in fluid communication to one of a plurality of first segments 137 of the segmented liquid inlet. Nozzle 50 is also connected in fluid communication with second liquid feed channel 140 which is connected in fluid communication to one of a plurality of second segments 139 of the segmented liquid inlet. A first portion of first segment 137 of the segmented liquid inlet is aligned with a corresponding nozzle 50 and supplies liquid directly to that nozzle 50. A portion of second segment 139 of the segmented liquid inlet is also aligned with the same nozzle 50 and supplies liquid directly to that nozzle 50. A second portion of first segment 137 of the segmented liquid inlet is aligned with another nozzle 50 and supplies liquid directly to that nozzle 50. A portion of a different second segment 139 of the segmented liquid inlet is also aligned with that nozzle 50 and supplies liquid directly to that nozzle 50.

As shown in FIG. 13A, first segment 137 of the segmented liquid inlet and second segment 139 of the segmented liquid inlet are positioned offset relative to each other as viewed from a plane perpendicular to a plane including nozzle 50. Positioning first segment 137 and second segment 139 in this manner enables a portion of a segment (either first segment 137 or second segment 139) to provide liquid to nozzles 50 that are aligned with the segment portion (represented by arrows 142) as well as provide liquid to nozzles 50 that are offset from the segment (represented by arrows 144) through an opening 110 in walls 126. As shown in FIG. 13, first segment 137 and second segments 139 supply liquid to two nozzles 50 that are aligned with or located across from each segment. Additionally, first segment 137 and second segments 139 help to supply liquid, through openings 110, to nozzles (not shown) on either side of each segment that are offset from or located adjacent to each segment although the primary supply of liquid to those nozzles typically comes from the first segment (not shown) and the second segment (not shown) that are aligned with or located across from those nozzles.

First segment 137 of the segmented liquid inlet includes ends 146 that are adjacent to ends 148 of second segment 139 of the segmented liquid inlet. As shown in FIG. 13B, ends 146 and 148 are aligned with each other (represented by dashed line 150). However, other configurations are permitted depending on the specific application contemplated. For example, end 146 of first segment 137 and end 148 of second segment 139 can overlap each other. Alternatively, ends 146 and 148 can be positioned spaced apart from each other.

As shown in FIGS. 13A and 13B, first segment 137 and second segment 139 of segmented liquid inlet each have a width that corresponds to the spacing between two adjacent nozzles 50. Adjacent segments, for example, the pair of second segments 139 shown in FIGS. 13A and 13B, are separated by the thickness of wall 126. Configuring first segments 137 and second segments 139 in this manner allows nozzles 50 to be fed from first segments 137 of segmented liquid inlet (through first liquid feed channels 138) that are directly in line with nozzles 50, and to be fed from second segments 139 of segmented liquid inlet (through second feed channels 140) that are directly in line with nozzles 50. This helps to ensure that the velocity of the fluid entering nozzle 50 through the first liquid feed channel 138 and matches the velocity of the fluid entering nozzle 50 through the second liquid feed channel 140 for each nozzle of the nozzle array. A mismatch in these velocities can affect the directionality of the liquid jetted from the nozzle.

As shown in FIGS. 11-13B, first drop forming mechanism 28 is a resistive heater 51 and second drop forming mechanism 29 is a resistive heater 51. Alternatively, first drop forming mechanism 28 can be a piezoelectric actuator and second drop forming mechanism 29 can be a piezoelectric actuator. First drop forming mechanism 28 and second drop forming mechanism 29 are different portions of the same drop forming mechanism (resistive heater or heating element 51). Resistive heating element 51 is shown in an example configuration that includes two parallel legs of resistive material 133. Electrical leads 156A and 156B are connected to each resistive material leg 133 and extend from legs 133 in opposite directions toward opposite sides of substrate 128. Electrical leads 156A are located in between adjacent segmented inlets 137 and electrical leads 15613 are located in between adjacent segmented inlets 139. Other resistive heating element configurations, however, are permitted. A similar resistive heater configuration is also shown with reference to FIGS. 4-8. Alternatively, first drop forming mechanism 28 and second drop forming mechanism 29 can be distinct devices.

Referring back to FIGS. 1-3 and 10-13B, having described the basic components of liquid ejector 120, the operation of liquid ejector 120 will now be described. A liquid, for example, ink, is supplied to jetting module 48 under pressure sufficient to continuously eject a jet or filament of the liquid through nozzle 50. The liquid enters and flows through nozzle 50 from opposite directions after passing through first and second liquid feed channels 138, 140 and traveling through first and second segments 137, 139 of segmented liquid inlet.

As the liquid travels through first and second liquid feed channels 138, 140, first drop forming mechanism 28 and second drop forming mechanism 29, for example, resistive heating elements 51, are positioned in first and second liquid feed channels 138, 140 and are in thermal contact with the liquid. As described above, a plurality of drop forming mechanism control circuits 26 read data from the image memory and apply time-varying electrical pulses to resistive heaters 51 through electrical leads 156A and 156B that are associated with nozzles 50 of printhead 30. These pulses are applied at an appropriate time, and to the appropriate nozzle, so that drops formed from a continuous ink jet stream will form spots on recording medium 32 in the appropriate position designated by the data in the image memory.

During operation, as the liquid travels through first liquid feed channel 138, the distance between first surface 112 and second surface 114 changes, becoming smaller, as the liquid moves from second portion 138B of first liquid feed channel 138 to first portion 138A of the first liquid feed channel 138. The distance between first surface 112 and second surface 114 changes, becoming larger, as the fluid moves from the first portion 138A of the liquid feed channel 138 toward nozzle 50. Liquid traveling through second liquid feed channel 140 experiences a similar travel path. In example embodiments in which the drop forming mechanisms 28 and 29 are heaters, actuating the heaters causes the viscosity of the liquid flowing past the heater to change. Positioning first drop forming mechanism 28 and second drop forming mechanism 29 in the first portion 138A of first liquid feed channel 138 and in the first portion 140A of second liquid feed channel 140 helps to improve (for example, increase or enhance) the modulation in the flow rate of the liquid flowing through the liquid feed channels 138 and 140 and thus through nozzle 50.

When the heaters of the drop forming mechanisms are actuated, the liquid adjacent to the heater gets hotter than the liquid adjacent to the opposite wall of the liquid feed channel. In the region of liquid ejector 120 where the liquid from the first liquid feed channel 138 meets the liquid from the second liquid feed channel 140, the hotter portions of the liquid, which correspond to the regions of the liquid with the higher amount of thermally induced viscosity change, get concentrated toward the center of the liquid passing through nozzle 50. Concentrating the hotter portions of the liquid toward the center of the liquid passing through the nozzle reduces the temperature modulation at the surface of the jet emitted from the nozzle when compared to a conventional thermally modulated continuous liquid ejector. As a result, the perturbation of the liquid jet that leads to drop formation using the continuous liquid ejector configuration of the present invention occurs primarily due to the viscosity modulation of the liquid and not primarily due to the surface tension modulation of the liquid jet that occurs in conventional continuous liquid ejectors. The viscosity modulation of the liquid jet is enhanced by positioning the drop forming mechanisms at location that are spaced apart from the nozzle as compared to conventional continuous liquid ejectors that position the drop forming mechanism adjacent to the nozzle. Accordingly, in additional example embodiments of the present invention, drop forming mechanisms 28 and 29 can be positioned in nozzle plate 49 along liquid feed channels 138 and 140 spaced apart from nozzle 50. In embodiments in which the drop forming mechanism is a mechanical displacement actuator, for example, a piezoelectric transducer, a electrostatic actuator, or a thermal bimorph actuator, actuation of the drop forming mechanism causes a portion of the wall of the first portions 138A and 140A of the liquid feed channels 138 and 140 to be displaced. This causes the flow impedance in the first portions 138A and 140A of the liquid feed channels 138 and 140 to change. As the distance between the first surface and the second surface in the first portions 138A and 140A of the liquid feed channels 138 and 140 is smaller than the distance between the first surface and the second surface in the second portions 138B and 140B of the liquid feed channels 138 and 140, the displacement of the drop forming mechanism produces a more significant change in flow impedance in the liquid feed channels and therefore a more significant change in the flow rate of liquid through the liquid feed channels when compared to positioning the drop forming mechanisms in the second portions 138B and 140B of the liquid feed channels 138 and 140.

As described above, an end 146 of first segment 137 of the segmented liquid inlet and an end 148 of second segment 139 of the segmented liquid inlet are aligned with each other. This allows a portion of first segment 137 and a portion of second segment 139 to provide liquid to and through nozzles 50 that are aligned with the segment portions. Using first segments 137 and second segments 139 in this configuration during operation allows nozzle 50 to be directly fed with liquid from portions of first segment 137 of segmented liquid inlet through first liquid feed channels 138 and portions of second segment 139 of segmented liquid inlet through second feed channels 140. Approximately equal amounts of liquid traveling at equivalent velocities enter nozzle 50 from first liquid feed channel 138 and second feed channel 140. This helps to maintain jet straightness during operation.

Figure 10:
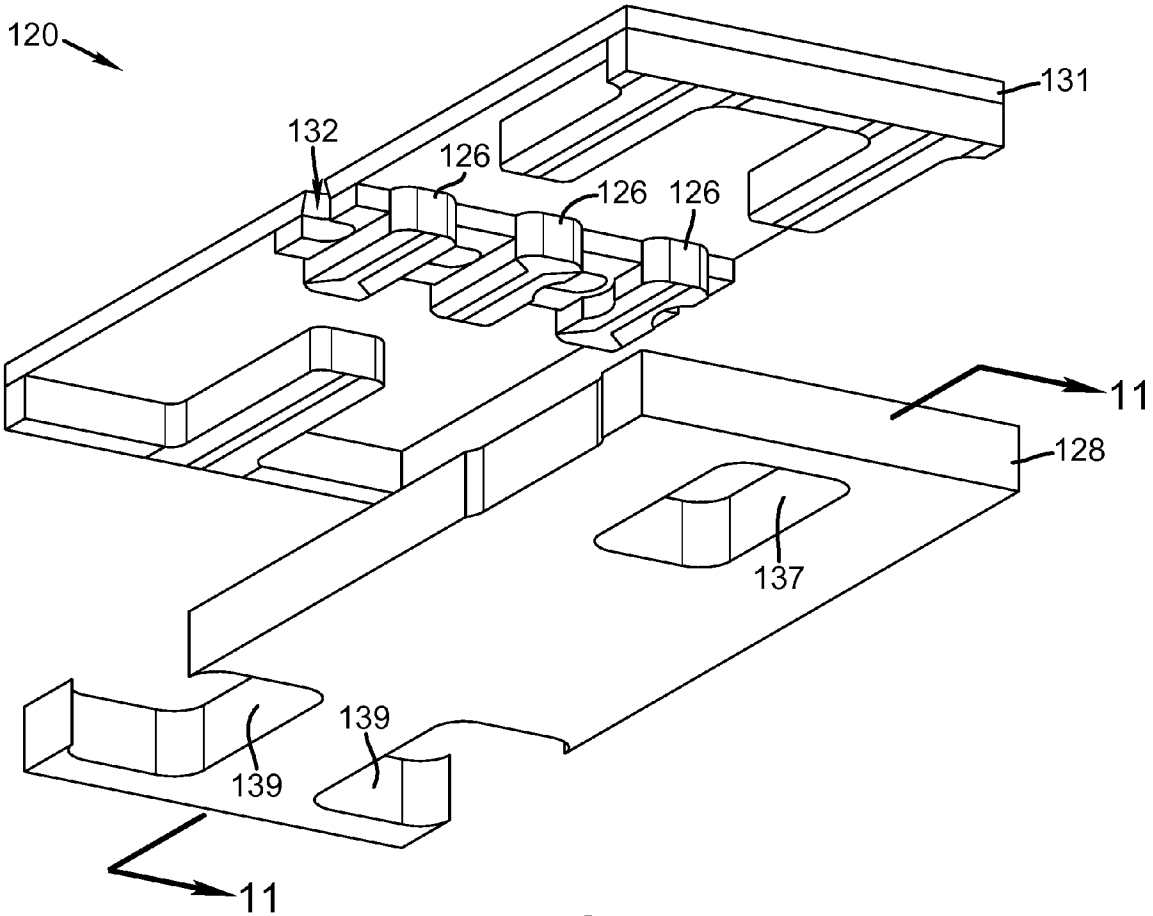
FIG. 10 is a schematic exploded perspective view of an example embodiment of a continuous liquid ejector of a continuous printhead made in accordance with the present invention.
Figure 11:
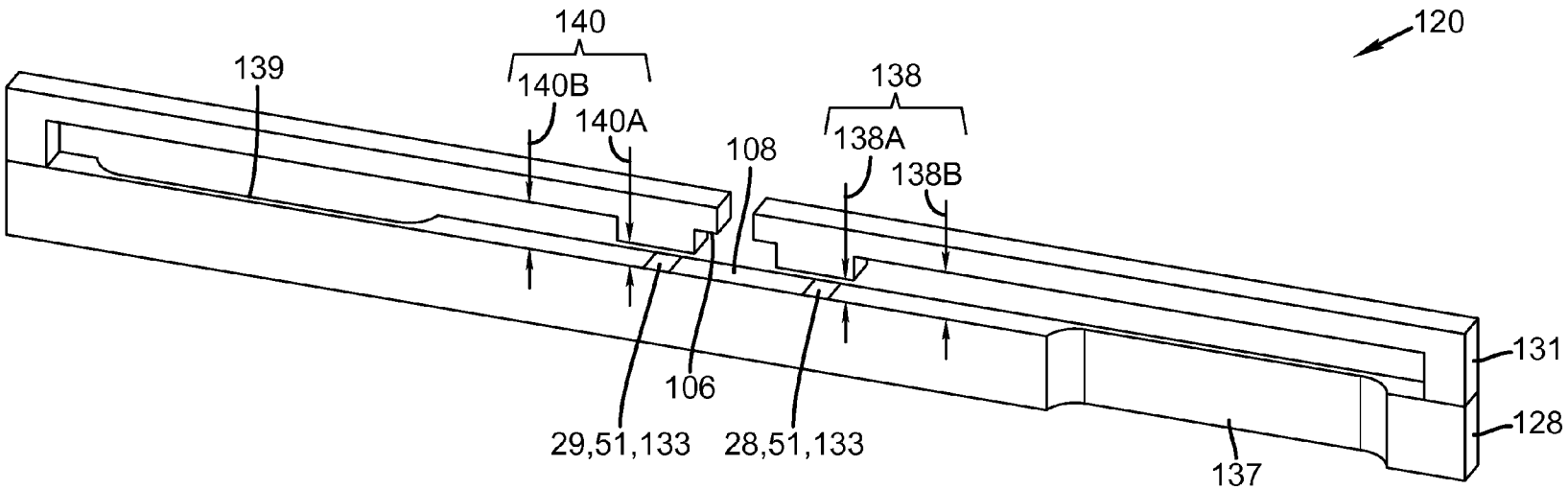
FIG. 11 is a schematic cross sectional view of the example embodiment shown in FIG. 10 as viewed along line 11-11 of FIG. 10.
Figure 12:
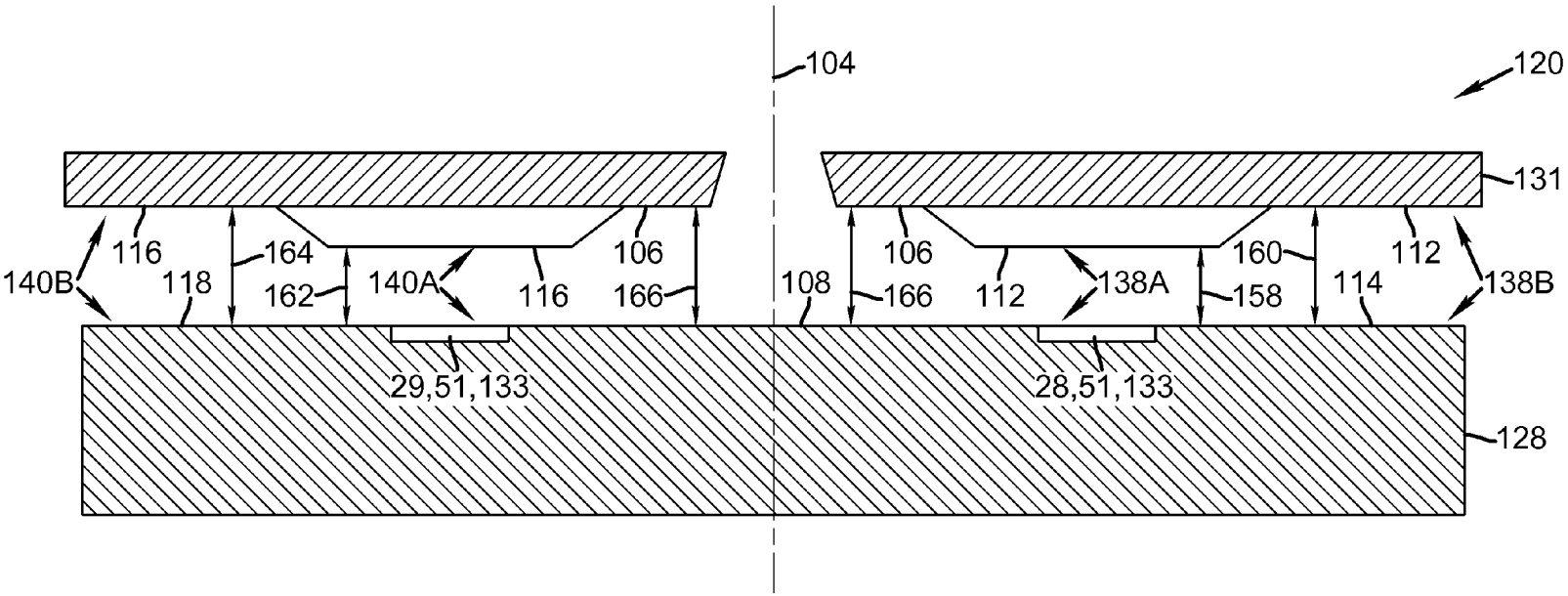
FIG. 12 is a partial schematic cross sectional view of the example embodiment shown in FIG. 11.
Figure 14:
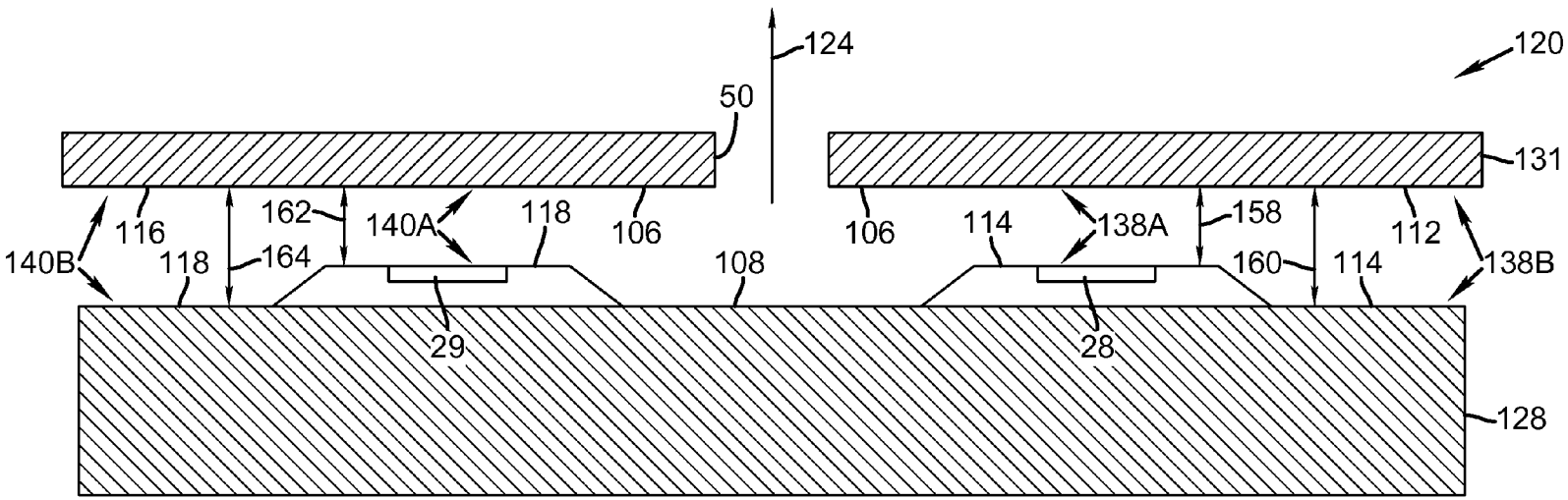
FIGS. 14-16 are schematic cross sectional views of additional example embodiments of continuous liquid ejectors made in accordance with the present invention.
Figure 15:
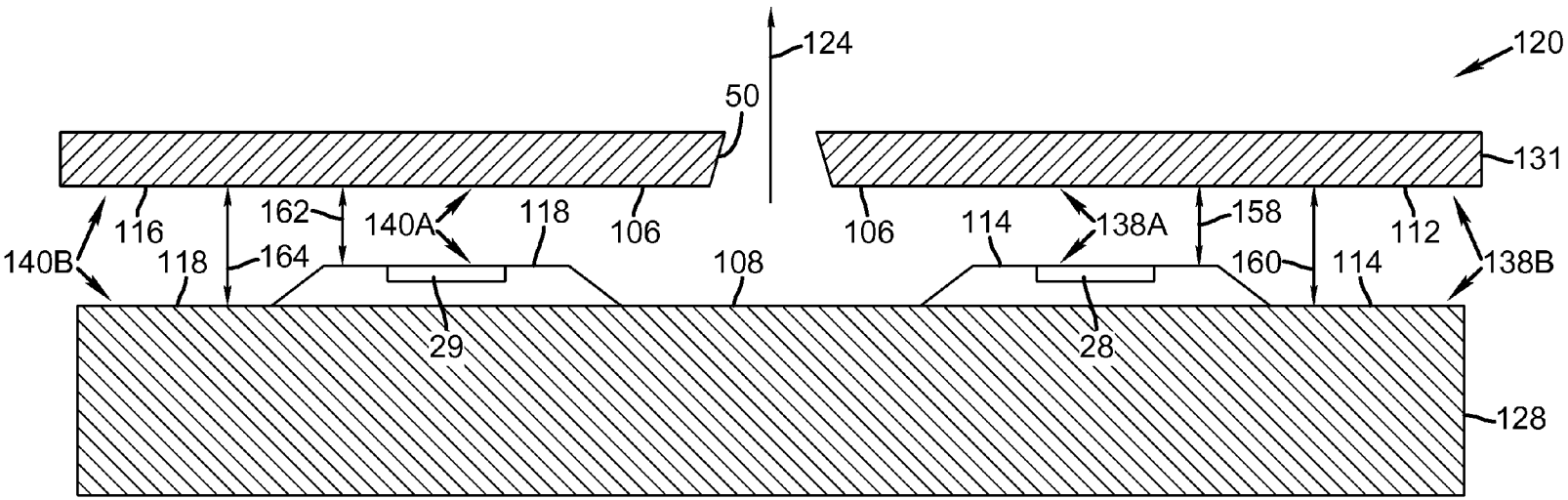
Figure 16:
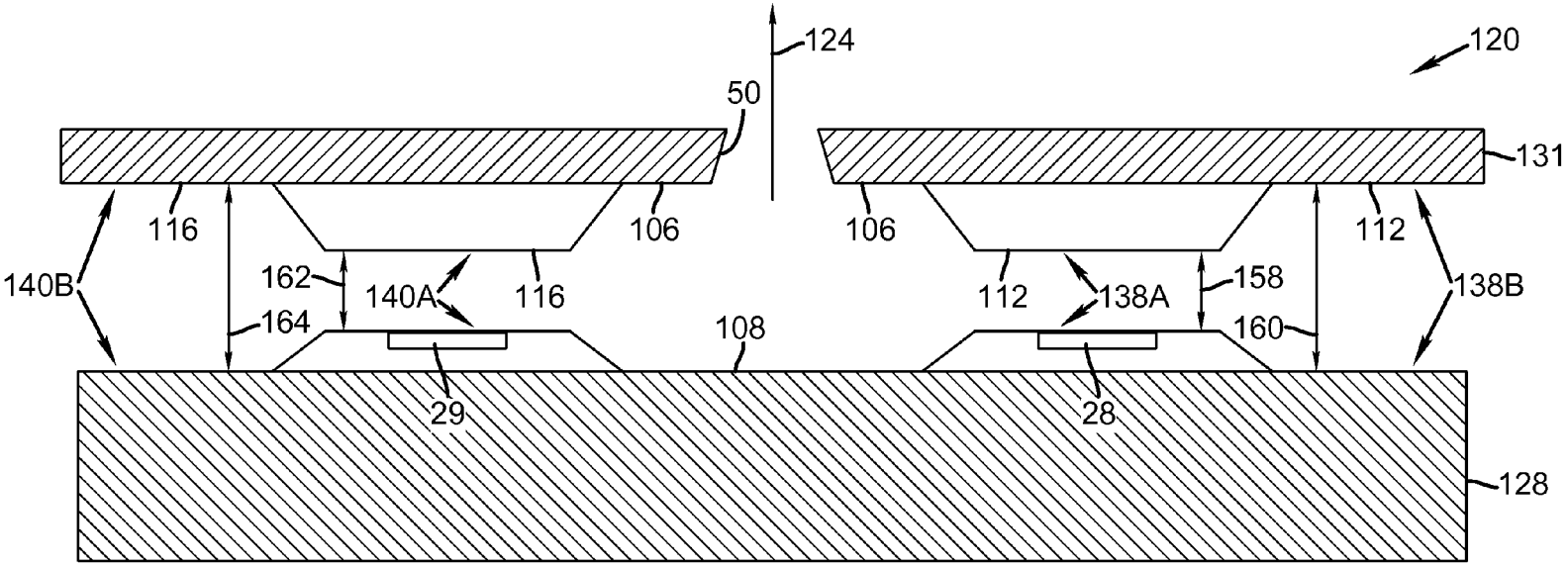

Referring to FIGS. 14-16, alternative embodiments of a portion of liquid ejector 120 are shown. In FIG. 14, distance 158 and distance 162 are smaller than distance 160 and 164 because a portion of substrate 128 extends into a first portion region 138A of first liquid feed channel 138 and into a first portion region 140A of second liquid feed channel 140 forming what is commonly referred to as a mesa in these regions. Drop forming mechanism 28 is positioned on the mesa located in the first portion 138A of first liquid feed channel 138 and drop forming mechanism 29 is located on the mesa located in the first portion 140A of second liquid feed channel 140. The wall(s) of nozzle 50 are straight and substantially parallel relative to the direction of liquid flow 124 through nozzle 50 in this example embodiment. In FIG. 15, the wall(s) of nozzle 50 tapers in the direction of liquid flow 124 through nozzle 50. In FIG. 10, distance 158 and distance 162 are smaller than distance 160 and 164 because a portion of nozzle plate 131 extends into first liquid feed channel 138 and second liquid feed channel 140 creating what is commonly referred to as an overhang. Additionally, distance 158 and distance 162 are smaller than distance 160 and 164 because a portion of substrate 128 extends into a first portion region 138A of first liquid feed channel 138 and into a first portion region 140A of second liquid feed channel 140. Drop forming mechanism 28 is positioned on the mesa located in the first portion 138A of first liquid feed channel 138 and drop forming mechanism 29 is located on the mesa located in the first portion 140A of second liquid feed channel 140. The wall(s) of nozzle 50 tapers in the direction of liquid flow 124 through nozzle 50. Alternatively, the wall(s) of nozzle 50 can be straight and substantially parallel relative to the direction of liquid flow through nozzle 50 in this example embodiment. As shown in FIG. 16, the heights of the mesas and the overhangs need not be the same.

The invention has been described in detail with particular reference to certain preferred embodiments thereof, but it will be understood that variations and modifications can be effected within the scope of the invention.

PARTS LIST

20 continuous printer system
22 image source
24 image processing unit
26 mechanism control circuits
28 drop forming mechanism
29 drop forming mechanism
30 printhead
32 recording medium
34 recording medium transport system
36 recording medium transport control system
38 micro-controller
40 reservoir
42 catcher
44 recycling unit
46 pressure regulator
47 channel

48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
98 plate
100 first side wall
102 second side wall
104 axis
106 surface
108 surface
110 opening
112 first surface
114 second surface
116 first surface
118 second surface
120 plurality of liquid ejectors
122 distance
124 liquid flow
126 walls
126A first side wall
126B second side wall
128 substrate
130 chamber
131 nozzle plate
133 resistive material
137 first liquid inlet
138 first liquid feed channel
138A first portion
138B second portion
139 second liquid inlet
140 second liquid feed channel
140A first portion
140B second portion
142 arrow
144 arrow
146 end
148 end
150 dashed line
156A electrical leads
156B electrical leads
158 distance
160 distance
162 distance
164 distance
166 distance
170 distance
172 distance
174 drop forming mechanism

The invention claimed is:

1. A continuous liquid ejector comprising:

a structure including a wall, a portion of the wall defining a nozzle, the nozzle having a first fluidic resistance $R_1$;

a first liquid feed channel in fluid communication with the nozzle, the first liquid feed channel having a second fluidic resistance $R_2$;

a first drop forming mechanism associated with the first liquid feed channel;

a second liquid feed channel in fluid communication with the nozzle, the second liquid feed channel having a third fluidic resistance $R_3$, the first fluidic resistance $R_1$ being less than the second fluidic resistance $R_2$ plus the third fluid resistance $R_3$ ($R_1<(R_2+R_3)$); and a second drop forming mechanism associated with the second liquid feed channel.

2. The ejector of claim 1, further comprising:

a segmented liquid inlet, a first segment of the liquid inlet being in liquid communication with the first liquid feed channel, and a second segment of the liquid inlet being in liquid communication with the second liquid feed channel.

3. The ejector of claim 1, wherein the first liquid feed channel and the second liquid feed channel have a mirror symmetry with respect to each other relative to the nozzle.

4. The ejector of claim 1, the nozzle including an axis, wherein the first liquid feed channel and the second liquid feed channel have a 180 degree rotational symmetry with respect to each other relative to the axis of the nozzle.

5. The ejector of claim 1, wherein the first drop forming mechanism is a heater and the second drop forming mechanism is a heater.

6. The ejector of claim 1, wherein the first drop forming mechanism is a piezoelectric actuator and the second drop forming mechanism is a piezoelectric actuator.

7. The ejector of claim 1, further comprising:

a third drop forming mechanism positioned between the first drop forming mechanism and the second drop forming mechanism.

8. The ejector of claim 1, wherein the first liquid feed channel includes an additional drop forming mechanism and the second liquid feed channel includes an additional drop forming mechanism.

9. The ejector of claim 1, wherein the first drop forming mechanism associated with the first liquid feed channel and the second drop forming mechanism associated with the second liquid feed channel are different portions of the same drop forming mechanism.

10. The ejector of claim 1, wherein:

the first liquid feed channel includes a first surface and a second surface, the first surface and the second surface of the first liquid feed channel being separated from each other by a distance, the distance being smaller in a first portion of the first liquid feed channel when compared to a second portion of the first liquid feed channel;

the first drop forming mechanism being associated with the first portion of the first liquid feed channel;

the second liquid feed channel includes a first surface and a second surface, the first surface and the second surface of the second liquid feed channel being separated from each other by a distance, the distance being smaller in a first portion of the second liquid feed channel when compared to a second portion of the second liquid feed channel; and the second drop forming mechanism being associated with the first portion of the second liquid feed channel.

11. The ejector of claim 10, wherein:

the first portion of the first liquid feed channel is located between the nozzle and the second portion of the first liquid feed channel; and the first portion of the second liquid feed channel is located between the nozzle and the second portion of the second liquid feed channel.

12. The ejector of claim 10, wherein:

the second portion of the first liquid feed channel is located between the nozzle and the first portion of the first liquid feed channel; and the second portion of the second liquid feed channel is located between the nozzle and the first portion of the second liquid feed channel.

13. The ejector of claim 10, wherein the first drop forming mechanism is positioned on a wall of the first liquid feed channel that is located opposite the nozzle and the second drop forming mechanism is positioned on a wall of the second liquid feed channel that is located opposite the nozzle.

14. The ejector of claim 1, wherein the first drop forming mechanism is positioned on a wall of the first liquid feed channel that is located opposite the nozzle and the second drop forming mechanism is positioned on a wall of the second liquid feed channel that is located opposite the nozzle.

15. A method of printing comprising:

providing a continuous liquid ejector including:

a structure including a wall defining a nozzle, the nozzle having a fluidic resistance $R_1$;

a first liquid feed channel in fluid communication with the nozzle, the first liquid feed channel having fluidic resistance $R_2$;

a first drop forming mechanism associated with the first liquid feed channel;

a second liquid feed channel in fluid communication with the nozzle, the second liquid feed channel having a fluidic resistance $R_3$, the fluidic resistance $R_1$ being less than the fluidic resistance $R_2$ plus the fluid resistance $R_3$ ($R_1<(R_2+R_3)$); and a second drop forming mechanism associated with the second liquid feed channel;

providing liquid under pressure sufficient to eject a liquid jet through the nozzle of the continuous liquid ejector;

simultaneously actuating the first drop forming mechanism and the second drop forming mechanism to cause a portion of the liquid to break off from the liquid jet and form a liquid drop.

16. The method of claim 15, further comprising:

providing an additional drop forming mechanism in the first liquid feed channel;

providing an additional drop forming mechanism in the second liquid feed channel; and simultaneously actuating the additional drop forming mechanisms in sequence with simultaneous actuation of the first and the second drop forming mechanisms.

* * * * *